US005533370A

United States Patent [19]

Kuroda et al.

[11] Patent Number: 5,533,370

[45] Date of Patent: Jul. 9, 1996

[54] TUBE ROLLING METHOD AND APPARATUS

[75] Inventors: Kouichi Kuroda, Takatsuki; Youichi Imamura, Amagasaki; Kazuyuki Nakasuji, Nishinomiya; Chihiro Hayashi, Takarazuka, all of Japan

[73] Assignee: Sumitomo Metal Industries, Ltd., Osaka, Japan

[21] Appl. No.: 158,276

[22] Filed: Nov. 29, 1993

[30] Foreign Application Priority Data

| | | | |
|---|---|---|---|
| Nov. 30, 1992 | [JP] | Japan | 4-345468 |
| Nov. 30, 1992 | [JP] | Japan | 4-345469 |
| Nov. 9, 1993 | [JP] | Japan | 5-279944 |

[51] Int. Cl.[6] ..... B21B 17/14; B21B 27/02

[52] U.S. Cl. ..... 72/12.5; 72/235; 72/252.5; 72/278; 72/367

[58] Field of Search ..... 72/206, 224, 234, 72/235, 278, 279, 367, 368, 14, 252.5, 370, 12.5

[56] References Cited

U.S. PATENT DOCUMENTS

| | | | |
|---|---|---|---|
| 1,352,493 | 9/1920 | Wolffgram | 72/235 |
| 1,779,478 | 10/1930 | Leech | 72/278 |
| 2,041,271 | 5/1936 | Stüting | 72/235 |
| 2,233,736 | 3/1941 | Findlater | 72/252.5 |
| 3,831,417 | 8/1974 | Ritter et al. | 72/235 |
| 4,260,096 | 4/1981 | Samarynov et al. | 72/235 |

FOREIGN PATENT DOCUMENTS

| | | |
|---|---|---|
| 60-44109 | 3/1985 | Japan . |
| 63-33105 | 2/1988 | Japan . |
| 4-4905 | 1/1992 | Japan . |
| 4-3681 | 2/1992 | Japan . |

OTHER PUBLICATIONS

Camp–ISIJ, vol. 2 (1989) *"Cold Stretch Reducing of Low Carbon Steel Pipes by 3 Roll–Hot Stretch Reducing Mill"*.

*Primary Examiner*—Lowell A. Larson
*Assistant Examiner*—Thomas C. Schoeffler
*Attorney, Agent, or Firm*—Burns, Doane, Swecker & Mathis

[57] ABSTRACT

According to the rolling method and the apparatus to be used for its execution of the invention, by rolling a tube to be rolled by using four rolls possessing roll grooves for forming a caliber in a shape of having a relief portion, cold reducing or cold stretch reducing is done continuously without causing wall thickness deviation, and by sizing the rolled tube material by a die disposed at the exit side, the dimensional precision and yield of rolled tubes may be enhanced by a small number of stands.

28 Claims, 19 Drawing Sheets

$D_1 / D_2 \geqq 10$ $\theta = 15° \sim 22.5°$ $R = 1.05b_1 \sim 1.20b_1$ $D_1 / D_2 \geqq 5$

TUBE ROLLING METHOD AND APPARATUS

BACKGROUND

1. Field of the Invention

The present invention relates to a rolling method and apparatus for continuously reducing the outer diameter of a hollow tube of carbon steel, stainless steel, or the like in a cold state, and to a method and apparatus for die processing, in addition to continuous cold reducing or cold stretch reducing.

2. Description of the Related Art

Hot stretch reducing is known as a method of producing metal tubes. In this method, a plurality of stands having three rolls forming arcuate grooves are disposed in tandem, and a heated mother tube is passed through the stands, so that the outer diameter of the mother tube is continuously reduced. Since this method is hot rolling, it involves its problems in the dimensional precision of the products and surface quality, and it is expensive due to the need for a heating furnace and fuel and other expense.

In producing of metal tubes, when a tube with small diameter of less than an inch is produced, generally, a hollow mother tube produced by hot rolling is acid-cleaned, lubricated, and then cold drawn by die or cold rolled by Pilger rolling mill.

FIG. 1 is a schematic side view showing the constitution of an apparatus in case of producing tubes by the cold drawing method. In the drawing, numeral 21 designates a tube, and the tube 21 is inserted into a die 22 having a circular hole. At the exit side of the die 22, a drawing machine 23 is disposed at a specified interval., and it is designed to draw a small diameter tube to reduce it in diameter. At this time, a chuck 24 disposed between the die 22 and the drawing machine 23 holds the small diameter tube. For this holding, as pretreatment of the drawing, a step for squeezing to reduce one end of the tube 21 is required. In drawing, a large tension is applied to the tube, but this tension must be limited to an extent that the mother tube may not be broken, and the reduction rate in one pass is limited, and when the total reduction rate becomes higher, moreover, the mother tube undergoes work-hardening and therefore intermediate annealing is required, which results in low yield and low working efficiency.

In the latter method of cold rolling, on the other hand, a pair of rolls having grooves tapered along the circumference are used and the tube is reduced in diameter and processed by moving the rolls reciprocally while pressing down by holding the tube by the rolls. In this cold rolling method, the reduction rate of mother tube in one pass is greater than the former method, but the working efficiency is inferior because the rolls must be moved reciprocally and pressed down upon the tube.

In producing small diameter tubes, the hot stretch reducing method mentioned above may be employed in certain cases, and the yield and working efficiency are notably enhanced by the hot stretch reducing method, but, as mentioned above, there are problems in the dimensional precision of products and surface quality. It also is expensive due to a need for a heating furnace and fuel and other expenses.

Accordingly, as disclosed in the Japanese Patent Application Laid-open 63-33105 (1988) and the collected papers of the 118th general meeting of Iron and Steel Society of Japan (CAMP-ISIJ, vol. 2, 1989, pp. 1494), the three-roll type cold stretch reducing method applying the hot rolling in cold rolling has been proposed.

FIG. 2(*a*) is a schematic side view explaining the arrangement of stands of a stretch reducer, and FIG. 2(*b*) is a schematic front view explaining the arrangement of stands of the stretch reducer. In the drawings, numeral 25 designates rolls, and a plurality of stands 26, 27, 28, . . . having three rolls 25, 25, 25 disposed at intervals of 120 degrees around pass line X are disposed in the pass line direction. The stands are arranged in tandem, by matching the calibers, varying the phase of the roll disposition of the adjacent stands by 60 degrees, and decreasing the caliber diameters gradually. In the final stand, a stand of round caliber is disposed.

Stand calibers consist of round calibers and oval calibers. FIGS. 3(*a*), (*b*) are sectional views showing the calibers used in the three-roll stretch reducer, and specifically FIG. 3(*a*) shows the round caliber, and FIG. 3(*b*), the oval caliber. The round caliber is a caliber composed of an arc $R_1$ having the center in the caliber center, and the oval caliber is a caliber having another arc $R_2$, with the center of the arc located on the center line of the roll gap, in the relief part of the caliber.

Among stands having oval calibers and round calibers consisting of three rolls, while applying a tension to the tubes between stands by setting the peripheral velocity ratio of roll surface between the adjacent stands larger than the elongation rate of tubes in a single stand, the mother tube is continuously passed among stands to reduce it to desired outer diameter.

In such three-roll cold stretch reducing method applying hot rolling in cold rolling, the tube wall thickness increases or decreases in the circumferential direction due to the reason mentioned below to cause so-called wall thickness deviation, and the inner sectional shape of the tube is deformed into a hexagonal form as shown in FIG. 4. That is, in hot stretch reducing, the friction coefficient of roll and mother tube is 0.3, and a sufficient tension is obtained among stands, and increase of wall thickness being a cause of wall thickness deviation is sufficiently suppressed, and deviation hardly occurs, but in cold stretch reducing, the friction coefficient is less than 0.1, being less than ⅓ of that of hot process, and sufficient tension cannot be obtained among the stands, and the increasing tendency of uneven wall thickness in the tube peripheral direction cannot be suppressed between the abutting portions of the roll groove bottom and roll groove edge.

Besides, seizure of the mother tube to the roll is caused by slipping by reason that the tension among stands is increased, or overfilling of mother tube into the roll gap occurs by reason that specified tension is not obtained.

To solve such problems, a method of rolling by setting the groove bottom diameter of the roll at 10 times or more of the outer diameter of the mother tube has been disclosed in the Japanese Patent Application Laid-open Hei. 4-4905.

FIG. 5(*a*) and FIG. 5(*b*) are conceptual diagrams explaining the ratio of outer diameter of mother tube and diameter of roll groove bottom, and rolling condition of mother tube, being a front view of roll and a side view of roll, respectively. Referring to these drawings, the method disclosed in the Japanese Patent Application Laid-Open 4-4905 is explained. Three rolls 31, 32, 33 are disposed around the pass line of mother tube A whose distance from central axis $C_2$ to the outer circumference is $D_2/2$, and the groove bottom radius of these rolls, that is the distance from the axial center $C_1$ to the groove bottom is $D_1/2$. By using the rolls 31, 32, 33 whose $D_1/D_2$ is 10 or more, the frictional force is enhanced, and the outer diameter of the mother tube A is continuously reduced in cold state.

In the conventional method as mentioned above, incidentally, since the contact area of the roll and mother tube is increased by setting the roll groove diameter at more than 10 times the outer diameter of the mother tube, a sufficient frictional force can be obtained even in the cold stretch reducing method being low in the coefficient of friction, so that a necessary tension among rolls is obtained. However, increase of contact area gives rise to increase of rolling force, that is, rolling load, and the required power for rolling and torque increases, and the increase of roll groove bottom diameter causes to increase the roll volume and gives rise to a substantial enlargement of facility, and problems of economy and facility are involved, and moreover in the three-roll rolling method, overfilling of tube into roll gap is likely to occur, and the reduction per stand cannot be increased, and therefore the rolling efficiency is poor, the number of stands required for reducing a tube to specified outer diameter increases, and the facility becomes gigantic.

SUMMARY

The invention has been devised to solve these problems, and it is hence a primary object of the invention to provide a method of performing cold reducing continuously without causing wall thickness deviation by using four rolls, and an apparatus to be used for the execution thereof. It is another object of the invention to provide a method of improving the dimensional precision and yield of rolled tubes by a small number of stands, by sizing with a die disposed at the exit side by using four rolls, and an apparatus to be used for the execution thereof.

The tube rolling method and rolling apparatus of the invention are characterized by the constitution in which plural stands comprising four rolls are constituted in tandem so as to be different in phase by about 45 degrees from the pass line, and these rolls possess the roll grooves forming nearly circular calibers satisfying the following conditions.

$$a_i > b_i$$

$$a_i < b_{i-1}$$

where $a_i$: caliber radius of roll groove edge of i-th stand $b_i$: caliber radius of roll groove center of i-th stand $b_{i-1}$: caliber radius of roll groove center of i-1-th stand Therefore, in the cold reducing with four rolls capable of reducing almost uniformly on the whole circumference, since the groove of the roll for forming the caliber is designed so that the radius of the groove edge part may be larger than the radius in the groove central part, a relief portion is formed in the caliber, and in this relief portion, therefore, overfilling of tube and formation of flaw on the tube surface are reduced, and the radius of the groove edge is set smaller than the radius of the middle part of the roll groove of the stand being one step up to the upstream side, and it is hence possible to reduce uniformly in the centripetal direction of tube axis in the groove center and edge of the groove, so that formation of wall thickness deviation may be suppressed.

It is hence a feature of the tube rolling method and rolling apparatus of the invention to use rolls which have the relief portion and roll grooves forming nearly circular calibers satisfying the following condition.

$$1.0 < a_i/b_i \leqq 1.050$$

It is another feature to use rolls which form nearly circular calibers satisfying the following conditions, and possess roll grooves in a shape being specific in the radius of curvature.

$$1.05 b_i \leqq R_i \leqq 1.20\ b_i$$

where $R_i$: radius of curvature of roll caliber of i-th stand Furthermore, it is also a feature to use rolls which possess roll grooves so as to form nearly circular calibers satisfying the following conditions.

$$0.88 \leqq b_i/b_{i-1} \leqq 0.95$$

$$0.60 \leqq (b_{i-1}-a_i)/(b_{i-1}-b_i) \leqq 0.90$$

Therefore, overfilling of tube and formation of flaw on tube surface are further decreased, and it is possible to roll uniformly in the centripetal direction of the tube axis in the groove center and edge parts of the roll, so that formation of wall thickness deviation may be suppressed.

The tube rolling apparatus of the invention is characterized by reducing the outer diameter of the tube to be rolled, by comprising rolls possessing calibers forming relief portions therein, with the roll groove bottom diameter being more than five times the outer diameter of the tube to be rolled. It is a feature of the rolling method to reduce the outer diameter of the tube to be rolled by 12% or less per stand, in addition to the above features. Therefore, with the rolls having a smaller diameter than in the constitution of three coils, cold rolling without corner squareness in inner sectional shape of the tube after rolling is achieved without causing roll-biting failure. Furthermore, in the rolling method with the reduction in outer diameter of 12% or less, it is possible to roll at a high reduction without causing slipping of roll or seizure of the tube to be rolled to the roll. Therefore, if the reduction per stand is set larger than in case of two-roll or three-roll type, over-filling of mother tube into the roll gap hardly occurs, so that the number of stands required for reducing the total outer diameter may be smaller.

It is another feature of the tube rolling method of the invention to roll the tube by adjusting the peripheral speed of the rolls of each stand so that the acceleration ratio of the peripheral speed at the groove center of roll of the extreme downstream side stand to the peripheral speed at the groove center of the roll of the extreme upstream side stand may be 1.0 to 1.8 times the reference acceleration ratio without action of tension on the stand tube. Therefore, a tension among stands can be obtained without slipping of the rolls, and the increase of wall thickness due to reduction of outer diameter of the tube to be rolled can be suppressed.

It is a feature of the tube rolling method and rolling apparatus of the invention to comprise rolls having calibers forming relief portions, with a die disposed at the exit side of the extreme downstream side stand among the stands, thereby sizing the tube to be rolled which has been Foiled and reduced by the die. Therefore, the precision of the finishing dimension is enhanced.

The tube rolling method of the invention can comprise a die, the reduction in outer diameter at the die being set at 0.5 to 5.0% during execution. Therefore, buckling of tube material may be prevented.

In the tube rolling method and rolling apparatus of the invention, the distance L between the center of the nearly circular caliber of the extreme downstream side stand and the inlet of the die bearing portion satisfies the following relation.

$$L \leqq 6 \times [\{d_1^4-(d_1-2t)^4\}/(d_1^2-d_2^2)]^{1/2}$$

where $d_1$: caliber diameter of roll of extreme downstream side stand t: wall thickness of tube to be rolled at the exit of extreme downstream side stand $d_2$: die diameter Therefore, slipping hardly occurs between the roll and tube, and seizure is prevented.

The tube rolling method and rolling apparatus of the invention can be provided with a die, and with a pinch roll at the exit side of the die, and when the tail end of the tube to be rolled is stopped between the roll and the die, the tail end is pulled out by the pinch roll. Therefore, when the tail end of the tube is stopped just before the die, the pinch roll holds the tube and rotates so that the tube can be drawn out.

In the tube rolling method and rolling apparatus of the invention, there is at least one detecting means for detecting the tail end of the tube to be rolled at the entrance of the plural stands or between the stands, and the pinch roll disposed at the exit side of the die is operated or stopped according to the result of the detecting means. Therefore, by judging the timing of stopping the tail end by the detecting means, the pinch roll holds the tube so that the tube may not be flawed.

It is a further feature of the tube rolling method and rolling apparatus of the invention that a sized tube is conveyed by using tube conveying means disposed at the exit side of the die. The conveying speed of the tube conveying means is greater than the exit side speed of the die. Therefore, the rolled tube can be conveyed easily.

The above and further objects and features of the invention will more fully be apparent from the following detailed description with accompanying drawings.

BRIEF DESCRIPTION OF THE DRAWINGS

FIG. 2(*b*) is a schematic front view explaining an arrangement of stands at a conventional stretch reducer.

FIG. 5(*b*) is a partial side view of a roll.

FIG. 12(*b*) is a partial side view of a roll of a rolling mill according to the invention.

DETAILED DESCRIPTION

Figure 1:
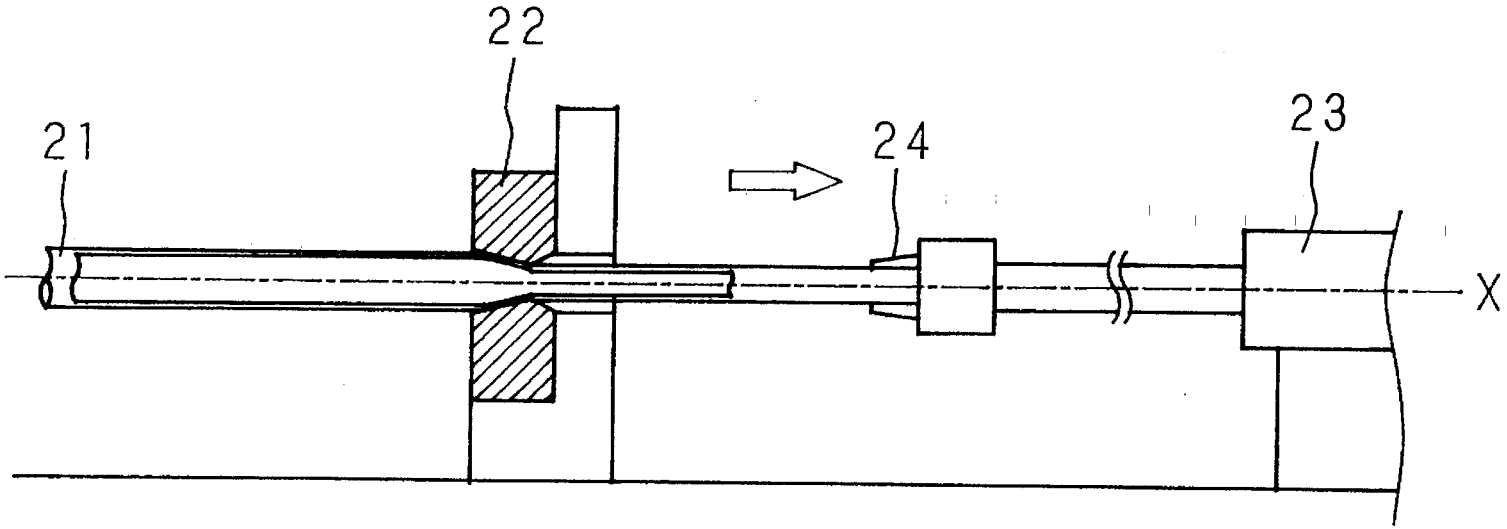
Fig. 1 Prior Art
FIG. 1 is a schematic side view showing a constitution of an apparatus used for conventional cold drawing method.
Figure 2A:
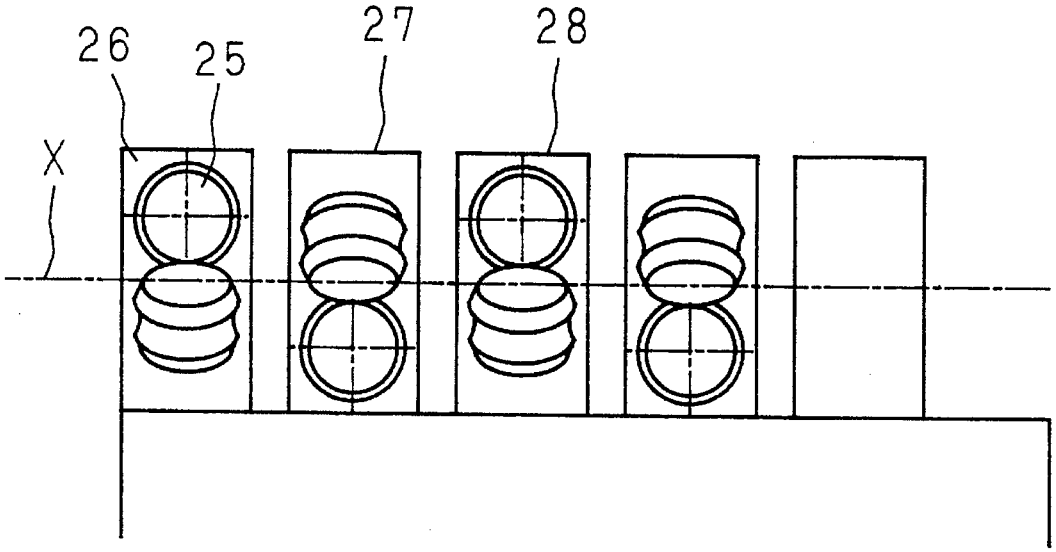
Fig. 2(a) Prior Art
FIG. 2(*a*) is a schematic side view explaining an arrangement of stands at a conventional stretch reducer.
Figure 2B:
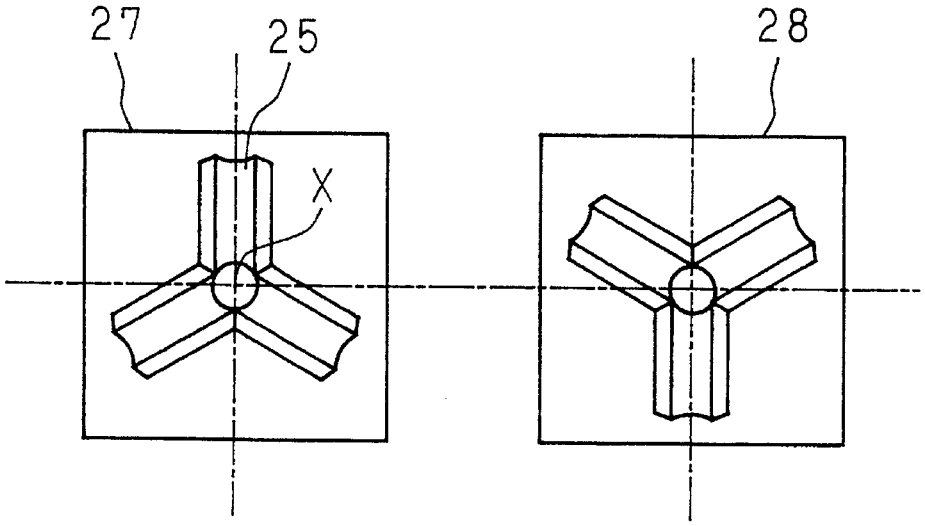
Fig. 2(b) Prior Art
Figure 3A:
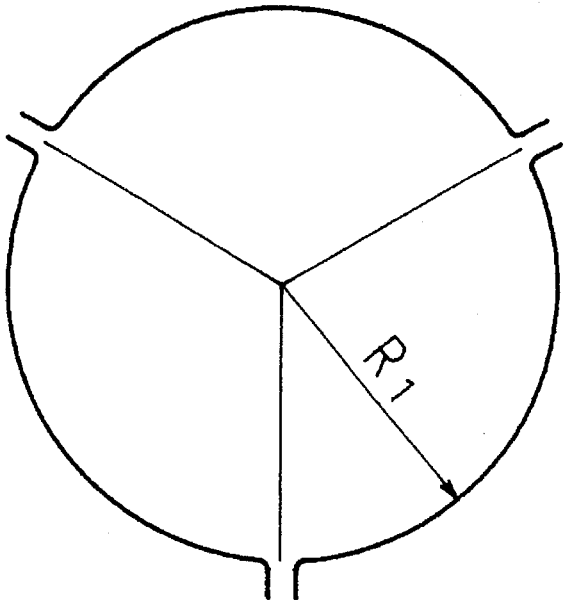
Fig. 3(a) Prior Art
FIGS. 3(*a*), (*b*) are sectional views showing a caliber used in the three-roll type stretch reducer.
Figure 3B:
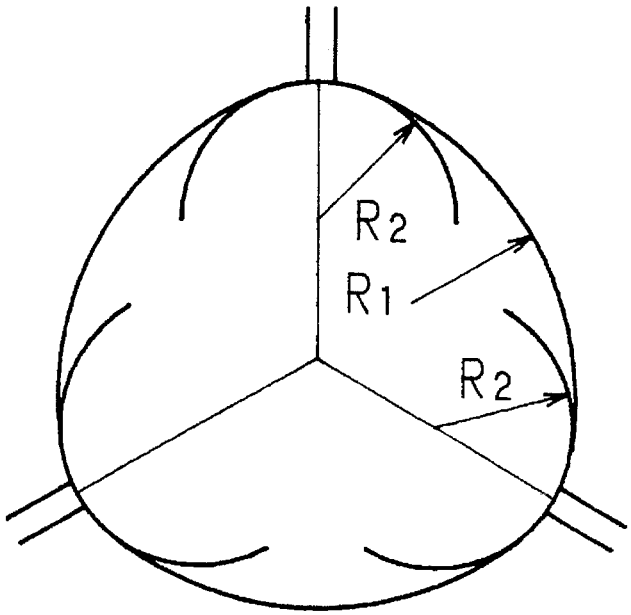
Fig. 3(b) Prior Art
Figure 4:
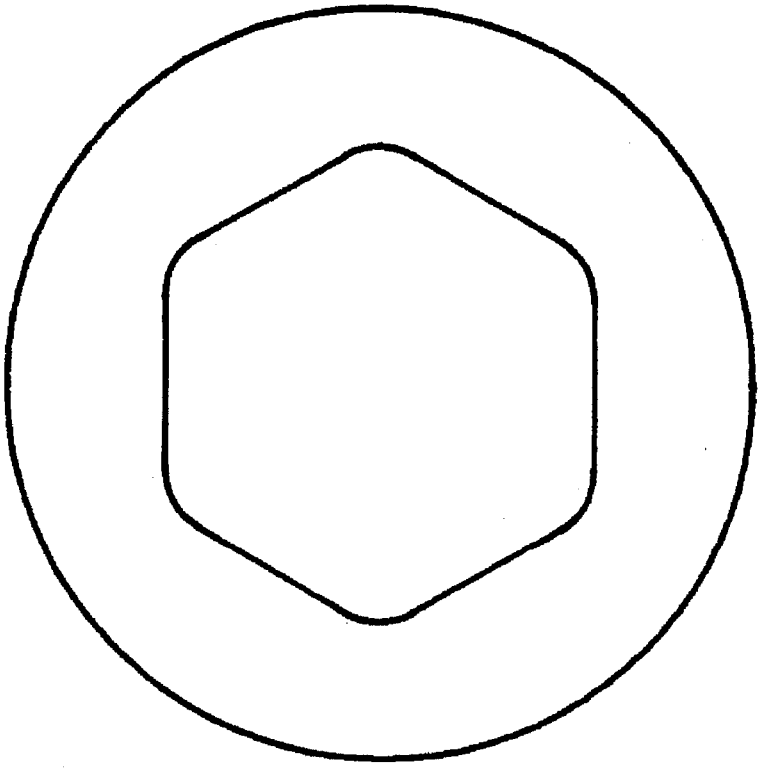
Fig. 4 Prior Art
FIG. 4 is a schematic diagram showing an internal shape of section of tube material.
Figure 5A:
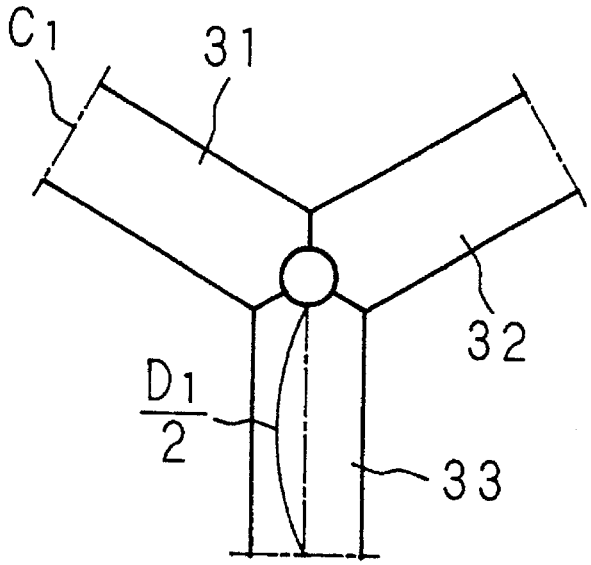
Fig. 5(a) Prior Art
FIG. 5(*a*) is a partial front view of a stand of a conventional rolling mill.
Figure 5B:
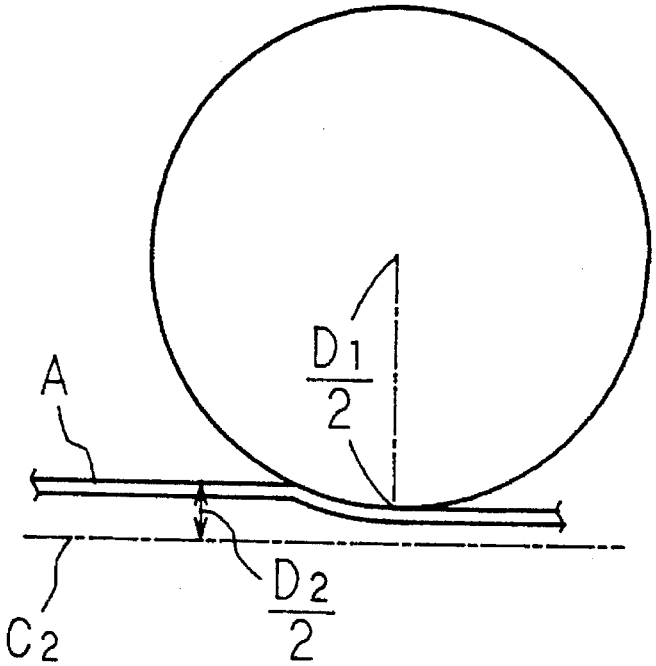
Fig. 5(b) Prior Art

The invention is described in detail below referring to the drawings showing the embodiments thereof.

Figure 6:
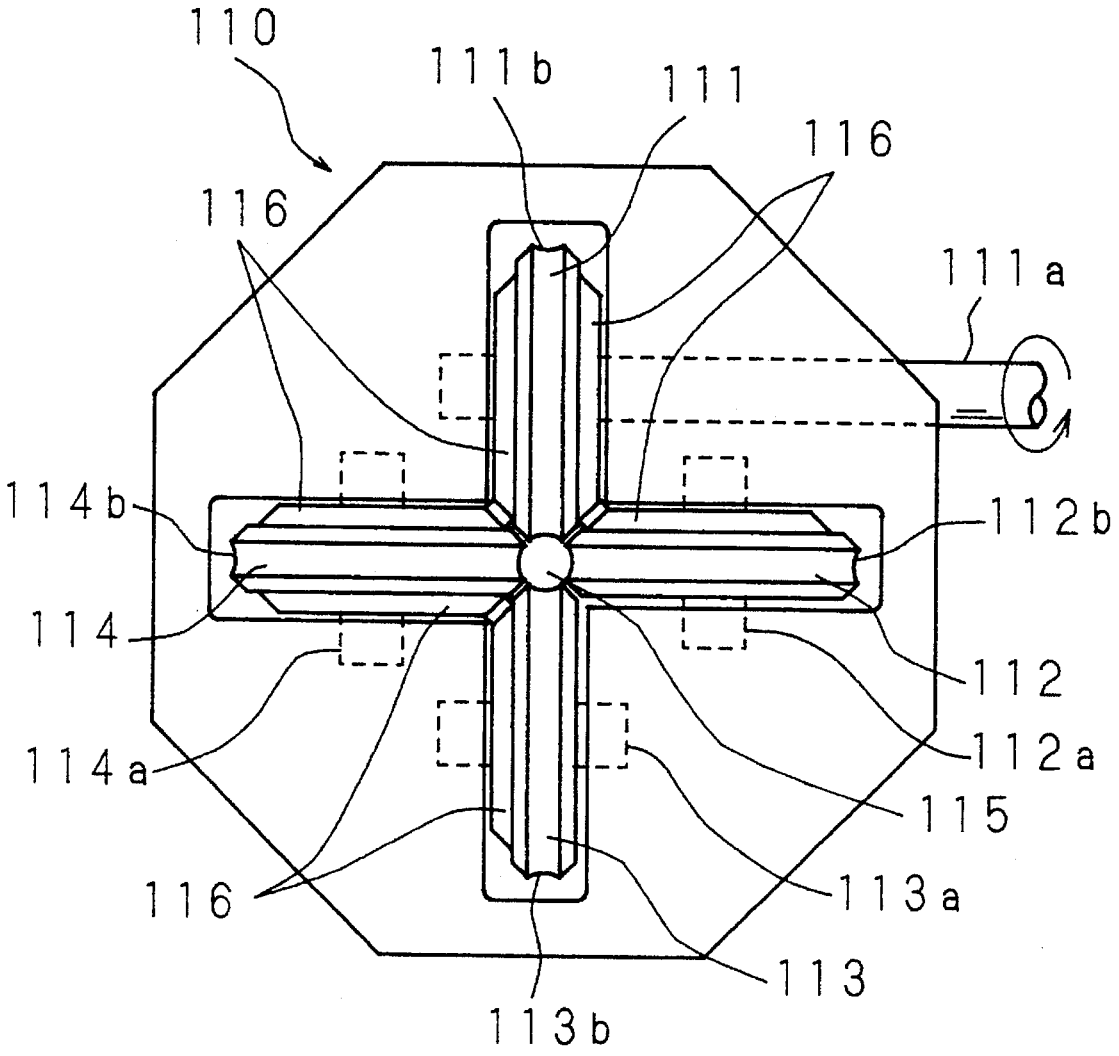
FIG. 6 is a front view showing a constitutional example of a caliber of a cold reducer according to the invention.

FIG. 6 is a front view showing a constitutional example of caliber of a cold reducer according to the invention, in which numerals 111, 112, 113, and 114 designate rolls. The rolls 111, 112, 113, 114 have grooves 111*b*, 112*b*, 113*b*, 114*b* cut in their circumferential surfaces to form a caliber 115, and at both sides of the rolls 111, 114 and at one side of the rolls 112, 113, internal gears 116, 116, . . . are fixed individually so as to be mutually engaged on the circumferential surfaces. The rolls 111, 112, 113, 114, and internal gears 116, 116, . . . are fixed to roll shafts 111*a*, 112*a*, 113*a*, 114*a* disposed rotatably at the openings of roll housings 110 having a cross opening, and by driving the roll shaft 111*a* projecting from the side wall of the roll housing 110, all rolls 111, 112, 113, 114 can be driven simultaneously by the internal gears 116, 116, . . .

Figure 7:
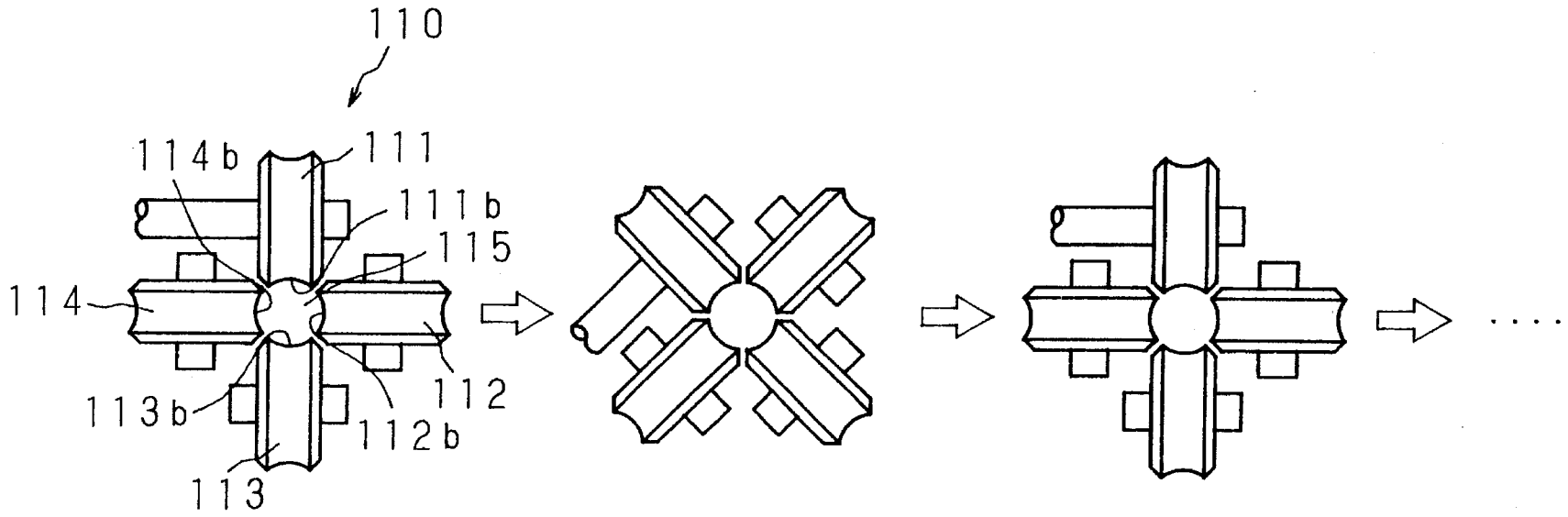
FIG. 7 is a schematic diagram explaining an arrangement of stands of the cold reducer according to the invention.

FIG. 7 is a schematic diagram for explaining an arrangement of stands. The stands are arranged in tandem by matching the calibers 115, 115, . . . The rolls 111, 112, 113, 114 of the stands are shifted by 45 degrees in phase relatively to the pass line with respect to the rolls 111, 112, 113, 114 of the upstream stands.

Figure 8A:
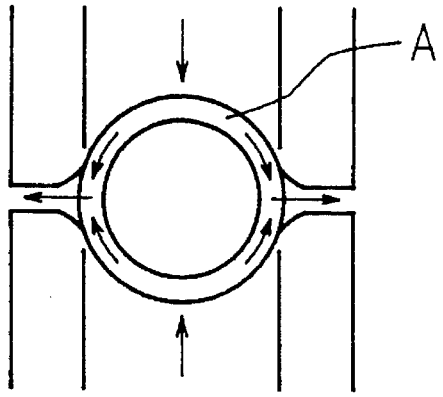
FIGS. 8(*a*), (*b*), (*c*) are schematic diagrams expressing in vectors the states of stress acting on a hollow mother tube in the roll gap.
Figure 8B:
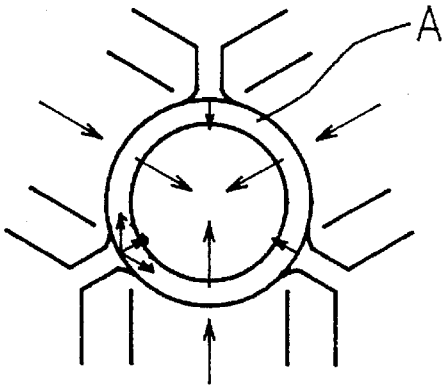
Figure 8C:
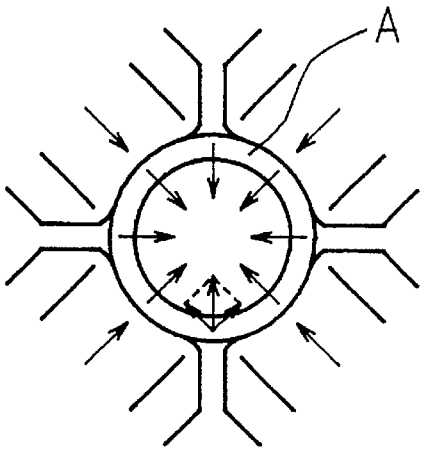

In FIGS. 8(*a*), (*b*), (*c*), the state of the stress acting on the hollow mother tube in the roll gap by the number of rolls for forming the calibers is expressed in vectors in a schematic diagram, and FIG. 8(*a*) and FIG. 8( *b*) show the two-roll and three-roll types, and FIG. 8(*c*) shows the four-roll type of the invention. As clear from the diagrams, in case of two-roll type, the mother tube A tends to overfill into the roll gap due to the stress received in the roll gap direction, and in case of three-roll type, the stress in the peripheral direction from the centripetal direction of the tube axis acts in the roll gap, which may cause wall thickness deviation. In the four-roll type of the invention, the stress in the peripheral direction is suppressed in the roll gap, and a almost; uniform rolling is performed on the whole circumference. Accordingly, if the reduction per stand is set larger than in two-roll or three-roll type, overfilling of mother tube into the roll gap hardly occurs, so that the number of stands required for the reduction of total outer diameter can be decreased.

Furthermore, at both edges of the groove cut in the circumference of the roll forming the calibers, in order to prevent overfilling of mother tube into the roll gap and formation of flaw on the mother tube at the groove edge, the caliber radius of the groove edge is set larger than the caliber radius of the groove bottom. This point is further described below.

Figure 9:
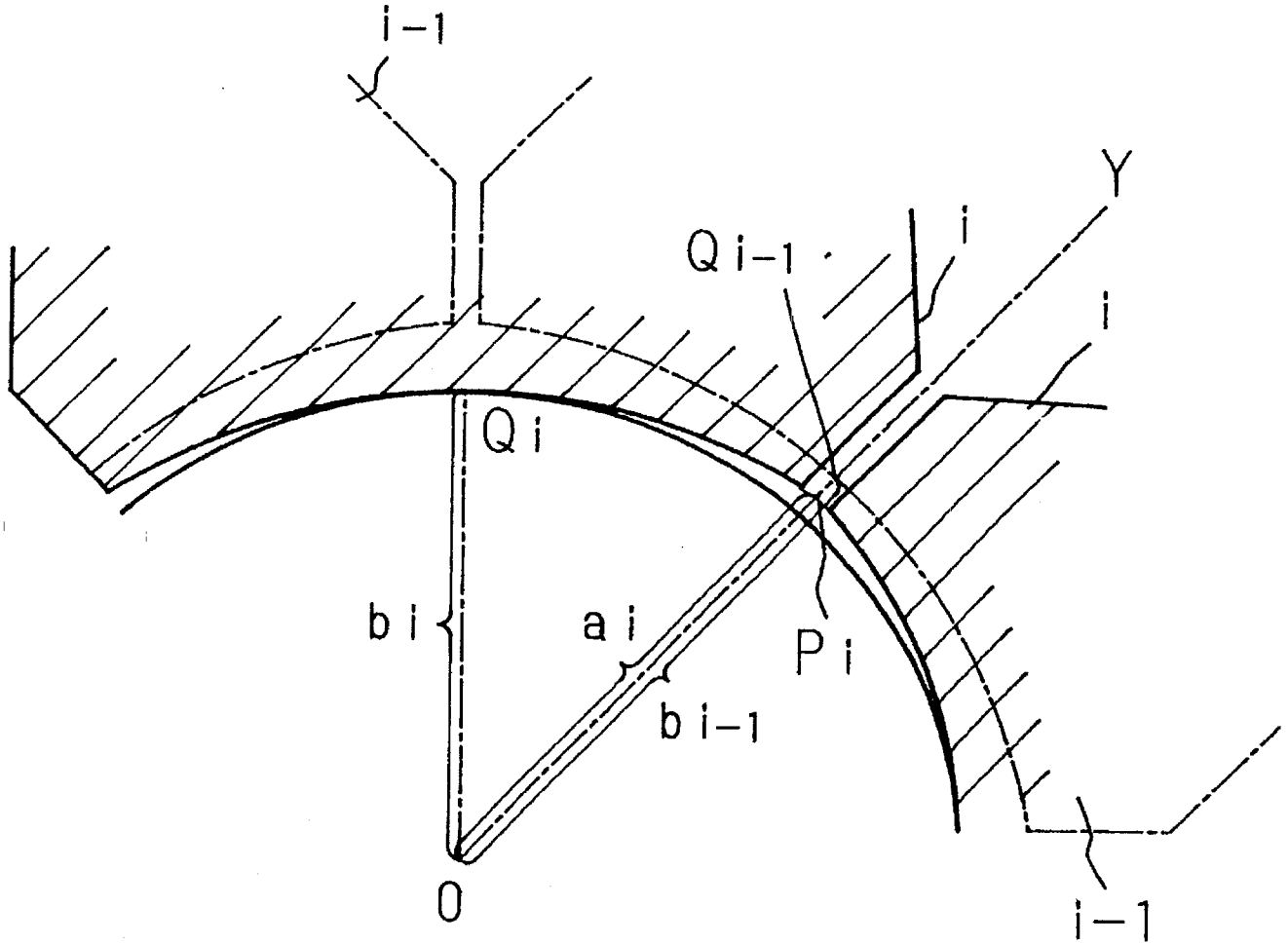
FIG. 9 is a schematic diagram for explaining a caliber shape according to the invention.

FIG. 9 is a schematic diagram for explaining the caliber shape according to the invention, in which i designates a roll of an i-th stand, and (i−1) designates a roll of an (i−1)-th stand one position closer to the upstream side. As mentioned above, the roll i and roll (i−1) differ in phase by 45 degrees relatively to the pass line. The intersection of the caliber virtual line formed by the neighboring roll i and virtual line OY from caliber center O of the pass line to the roll gap middle part is $P_i$, and the contact point of the caliber virtual line and groove middle part of roll i is $Q_i$, then the $OP_i$ distance is the radius of the roll i to the gap middle part, and the $OQ_i$ distance is the radius $b_i$ to the groove bottom in the middle of the groove.

Meanwhile, as shown in FIG. 9, the roll gap between adjacent rolls is present, but this roll gap is as small as about, for example, 0.1 to 0.2 mm, and the roll edge part in the roll gap part is cut off and made with a small corner radius of about 0.1 to 0.2 mm, and substantially the $OP_i$distance is equal to the radius $a_i$ of the roll i to the groove edge. Likewise, the radii of the roll (i−1) to the groove edge and to the groove bottom are respectively $a_{i-1}$ and $b_{i-1}$. At this time, the cold rolling apparatus of the invention employs the rolls which form such calibers that the relation between the radius $b_i$ to the groove bottom and the radius $a_i$ to the groove edge, and the relation between $a_i$ and $b_{i-1}$ may be given in the following formula.

$$a_i > b_i$$

$$a_i/b_{i-1} < 1 \quad (1)$$

Rewriting formula (1) yields $a_i - b_{i-1} < 0$, and the i-th caliber is a so-called side relief minus caliber having a minus difference between the radius of the roll to the groove edge and the radius of the roll (i−1) to the groove bottom. The side relief minus caliber provides the both groove edges of the caliber roll with relief portions, but the radius $a_i$ to the groove edge is set smaller than the radius $b_{i-1}$ to the groove bottom one stand before, and by disposing stands with side relief minus calibers, it is possible to roll a tube in the centripetal direction of tube axis uniformly to the mother tube, in the roll groove bottom and groove edge.

Furthermore, in the apparatus of the invention, the calibers of the stands are designed in the range given by formulas (2) and (3), using the above values of $a_i$, $b_i$ and $b_{i-1}$.

$$0.88 \leqq b_i/b_{i-1} \leqq 0.95 \quad (2)$$

$$0.66 \leqq (b_{i-1} - a_i)/(b_{i-1} - b_i) = \alpha \leqq 0.90 \quad (3)$$

In formula (2), $b_i/b_{i-1}$ being 0.88 and 0.95 suggests that the reduction in outer diameter per stand is 12% and 5%, and it means that overfilling of the mother tube into the roll gap occurs when the reduction in outer diameter exceeds 12%, and that the rolling with the reduction in outer diameter of less than 5% is not meaningful substantially except for the finishing stand, and hence the range is defined as specified above.

Rewriting the formula (1) yields $0 < b_{i-1} - a_i$, and when α is defined in the range specified in the formula (3), it means an appropriate minus relief extent for the side relief minus caliber, and by the definition of formula (3) when α=1, it follows that $a_i = b_i$, and the caliber is a round caliber. To prevent wall thickness deviation, what is ideal is a complete uniform compressive processing from the whole circumference by the round caliber, but over-filling occurs in this case, and hence the upper limit of α is set at 0.90 at which overfilling does not occur. On the other hand, as the value of α becomes smaller, $a_i$ becomes larger for $b_i$, and the caliber is changed from a round form to an oval form. When $a_i$ becomes too large for $b_i$, wall thickness deviation is likely to occur even in rolling with four rolls, and the inner surface is squared, and therefore the lower limit is defined at 0.60 at which the inner surface of the mother tube may not be squared.

The result of cold tube rolling of steel tube by the method and apparatus of the invention is compared with the reference case. The reference case, using four rolls, does not satisfy formula (1) and/or (2), (3).

Figure 10:
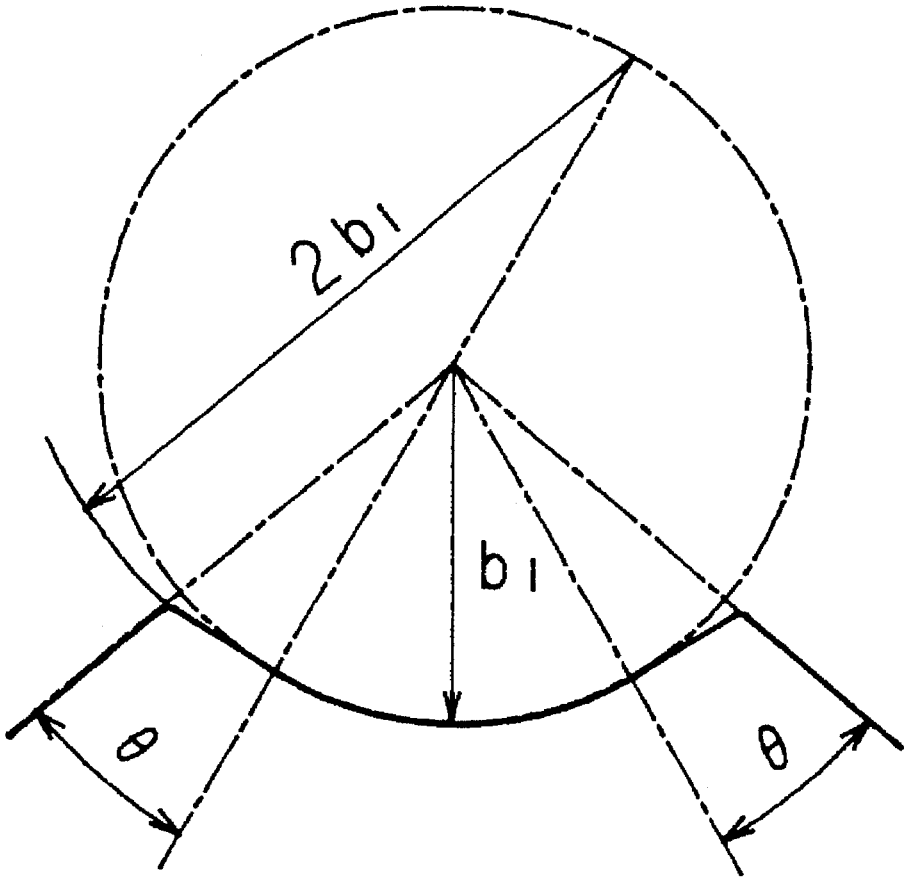
FIG. 10 is an explanatory diagram of a shape of groove edge of a roll used in the embodiment.
Figure 11:
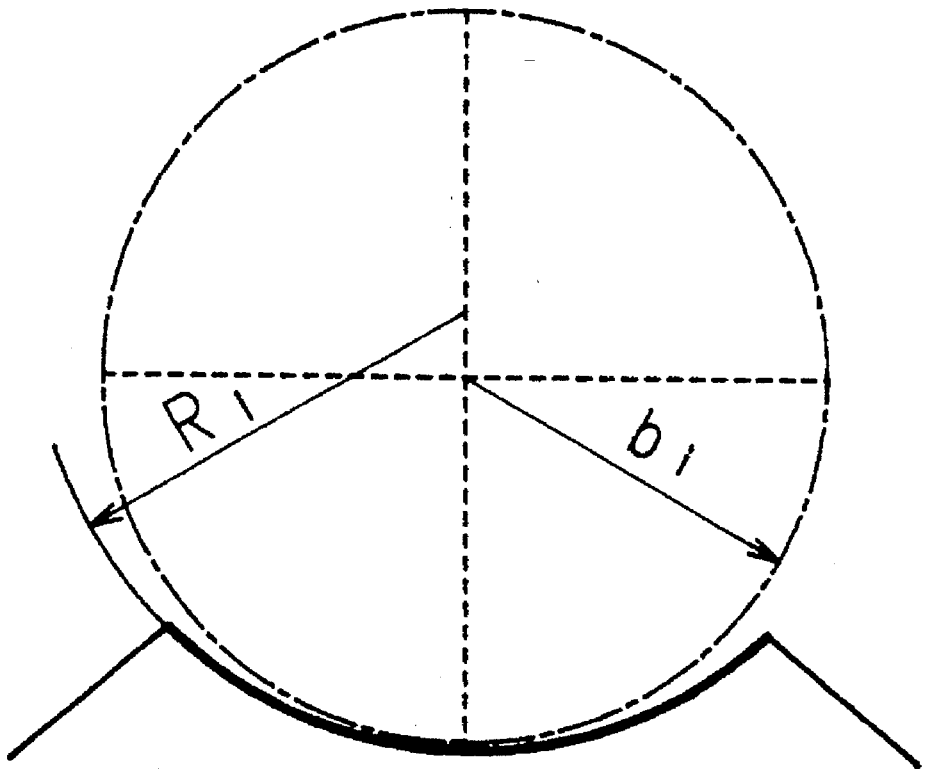
FIG. 11 is an explanatory diagram of a shape of groove edge of a roll used in the embodiment.

FIG. 10 and FIG. 11 are explanatory diagrams of the shape of the groove edge of the roll used in the embodiment, and two types were used, that is, the double radius type (DR type) having the center on the circumference of radius $b_i$ contacting with the groove bottom, and varying the angle θ formed by the groove edge contacting with the arc with radius $2b_i$ as shown in FIG. 10, and the single radius type (SR type) having the center on the line linking the center of the circle of radius $b_i$ contacting with the groove bottom and the lowest part of the groove, and varying the radius $R_i$ of the groove edge drawn by an arc of radius $R_i$ as shown in FIG. 11. The other conditions are as follows.

| | |
|---|---|
| Steel tube | Material: Low carbon steel<br>Dimensions: ø 18 mm × 2 mmt |
| Stand | Quantity: 6 stands + finishing stand<br>Nominal roll diameter: ø 140 mm |
| Lubricant | Water-soluble oil |

However, the finishing stand has the caliber in the same dimensions as the sixth stand varied by 45 degrees in phase from the pass line. The nominal roll diameter is the distance between confronting roll shafts.

Table 1 shows the result, the code of the rolling result in the column of overfilling in the table is ○ when overfilling does not occur, × when overfilling occurs, and Δ when it occurs slightly, and in the column of interior squareness, it is × when the ratio of maximum value/minimum value of inside diameter of the steel tube after rolling is 1.15 or more, Δ when 1.10 to 1.15, and ○ when 1.10 or less.

As clear from Table 1, in the embodiment, over-filling does not occur by using the rolls of caliber of either SR type or DR type, and wall thickness deviation is suppressed, and the inner surface of the steel tube after rolling is not squared. In the reference example, by contrast, when the reduction per stand is 13% and when α exceeds 0.90 in the formula (3), overfilling occurs, and when α is less than 0.60, squaring occurred in-the internal surface of steel tube after rolling.

On the other hand, when rolling is performed by the three-roll type cold tube stretch reducing method with the reduction in outer diameter per stand being 10%, over-filling occurred. To prevent over-filling with the reduction in outer diameter being 10%, the side relief must be positive, and in this case squaring occurred after rolling. The upper limit of the reduction in outer diameter to be free from overfilling at minus side of side relief was 6%, but squaring after rolling could not be prevented with the outer diameter reduction being 6%.

In this way, by setting in a proper range with respect to the radius of the middle and edge part of the roll grooves of the neighboring stands possessing four rolls, it is possible to roll in cold process without causing overfilling or squaring after rolling.

In the single radius caliber, incidentally, the radius of curvature of the caliber is set somewhere between 1.05 times and 1.20 times of the caliber radius $b_i$ in the groove bottom. That is, the range of the offset extent e to the pass line center of the center of radius of curvature of the caliber is desired to be $$0.05b_i \leqq e \leqq 0.20\ b_i$$

That is, when the offset extent e exceeds 0.20 $b_i$, since the ratio of major radius and minor radius of the caliber is too large, formation of wall thickness deviation during rolling is avoided, and on the other hand, when the offset extent e is less than 0.05 $b_i$, since the caliber shape is too close to the round circle, overfilling into the roll gap occurs while rolling.

In the roll forming such single radius caliber, since the radius of curvature is constant, it is possible to cut the roll calibers by disk cutter with the roll assembled in the roll unit. Hence, assembling labor of roll unit is saved, and the roll caliber can be cut regardless of the fine adjustment in the roll width direction and assembling precision.

Table 2 shows the result of judgement on the necessity of how much the ratio ($a_i/b_i$) or the major radius to the minor radius of the caliber must be close to 1, and in the same way as above, continuous rolling of seven stands was compared with outer diameter reduction per stand being 10%. In the column of internal surface squaring, in the same way as above, it is expressed by × when the ratio of maximum value/minimum value of the inside diameter of steel tube after rolling is 1.15 or more, and ○ when 1.10 or less. As clear from Table 2, the ratio of the major radius to the minor radius of the caliber is desired to be $$1 < a_i/b_i \leqq 1.050.$$

Thus, using the four-roll stands, it is possible to roll a tube uniformly on the whole circumference of the tube to be rolled by setting the radius to the groove bottom and edge of the roll to satisfy the above condition.

Another embodiment of the invention is described below while referring to the accompanying drawings.

Figure 12A:
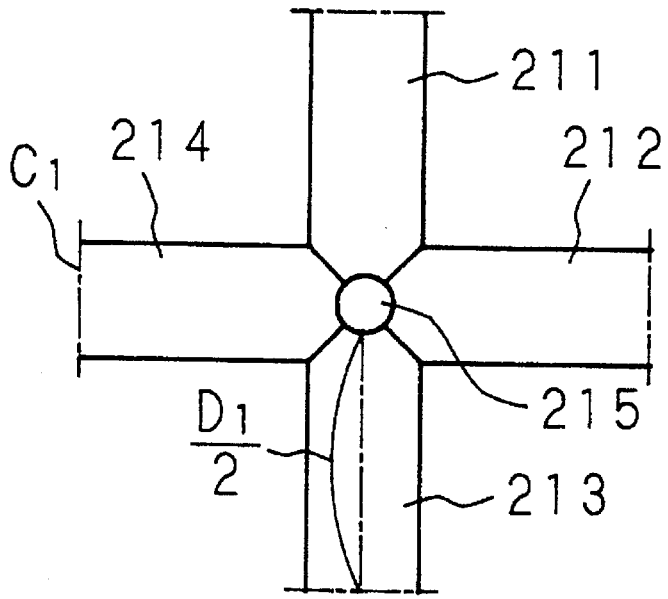
FIG. 12(*a*) is a partial front view of a stand of a rolling mill according to the invention.
Figure 12B:
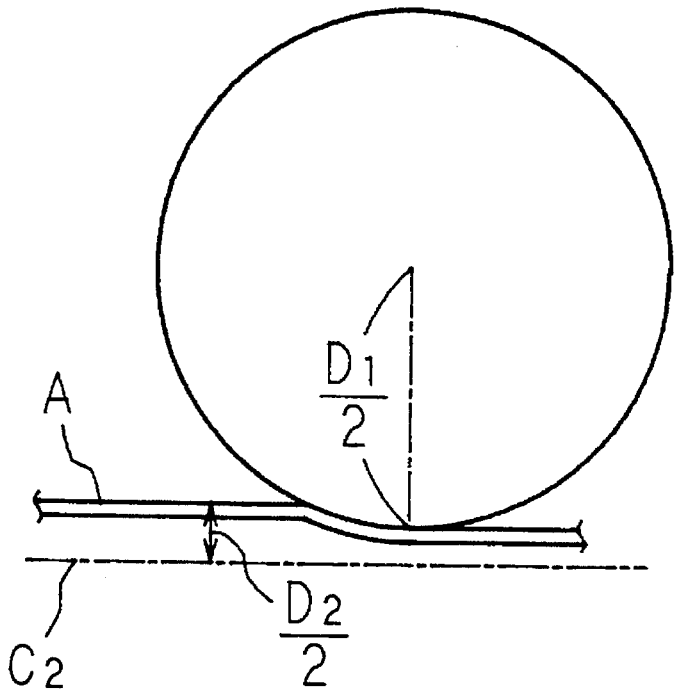

FIG. 12(*a*) is a partial front view a stand for forming the pass line, and FIG. 12(*b*) is a partial side view of a roll for rolling the mother tube, and these are conceptual diagrams for explaining the ratio of the outer diameter of the mother tube and roll groove bottom diameter, and rolling condition of the mother tube in the invention. The constitution of the stands and arrangement of the stands are same as in the cold reducer shown in FIGS. 6 and 7, and same reference numerals are given to the corresponding parts, and their explanations are omitted.

As shown in FIGS. 12(*a*), (*b*), in four rolls 211, 212, 213, 213 forming a caliber 215, the distance from the axial center $c_1$ of each roll shaft not shown in the drawing to the roll groove bottom is $D_1/2$, and the distance from the center axis $c_2$ of the mother tube A to the outer circumference is $D_2/2$. And the rolls 211, 212, 213, 214 having $D_1$ so that the ratio $D_1/D_2$ may be 5 or more are used outer diameter reduction per stand is 12% or less.

In the invention, since it is possible to roll almost uniformly on the whole circumference of the mother tube A as mentioned above, it is not necessary to suppress the internal surface squaring after rolling by making use of the tension obtained by setting $D_1/D_2$ at 10 or more as in the conventional case of three-roll type. In the invention, therefore, by setting the value of $D_1/D_2$ at 5 or more as the minimum value causing no overfilling trouble of the mother tube A into the caliber, stable rolling is realized by four rolls. In the invention, by setting the value of $D_1/D_2$ at 7 or more, the increase of tube wall thickness due to reduction of outer diameter can be suppressed.

In the invention, the outer diameter reduction per stand can be set higher than before, but slipping of a roll occurs when the outer diameter reduction is set over 12%, and to prevent this, if $D_1$ is increased, overfilling of the mother tube A into the roll edge occurs, and hence the upper limit of the outer diameter reduction is set at 12%.

On the other hand, by increasing the roll speed of the exit side stand faster than the roll speed of the entrance side stand, the tension between the stands can be obtained. When four rolls are used, wall thickness deviation can be prevented without obtaining tension, but when tension is obtained, increase of tube wall thickness due to reduction of outer diameter can be suppressed, which is beneficial for producing of rolled tube. In the invention, accordingly, the ratio of the speed of the entrance side stand roll to the exit side stand roll is set between the reference speed ratio and 1.8 times the reference speed ratio, the reference speed ratio being the ratio of the speed when tension does not act between the stands. By gradually increasing the speed of each stand so that the ratio of the speed of the rolls of the both stands may remain within this range, it is possible to obtain a specified tension without slipping of rolls.

The result of cold tube rolling of steel tube by the method of the invention is described below.

Figure 13:
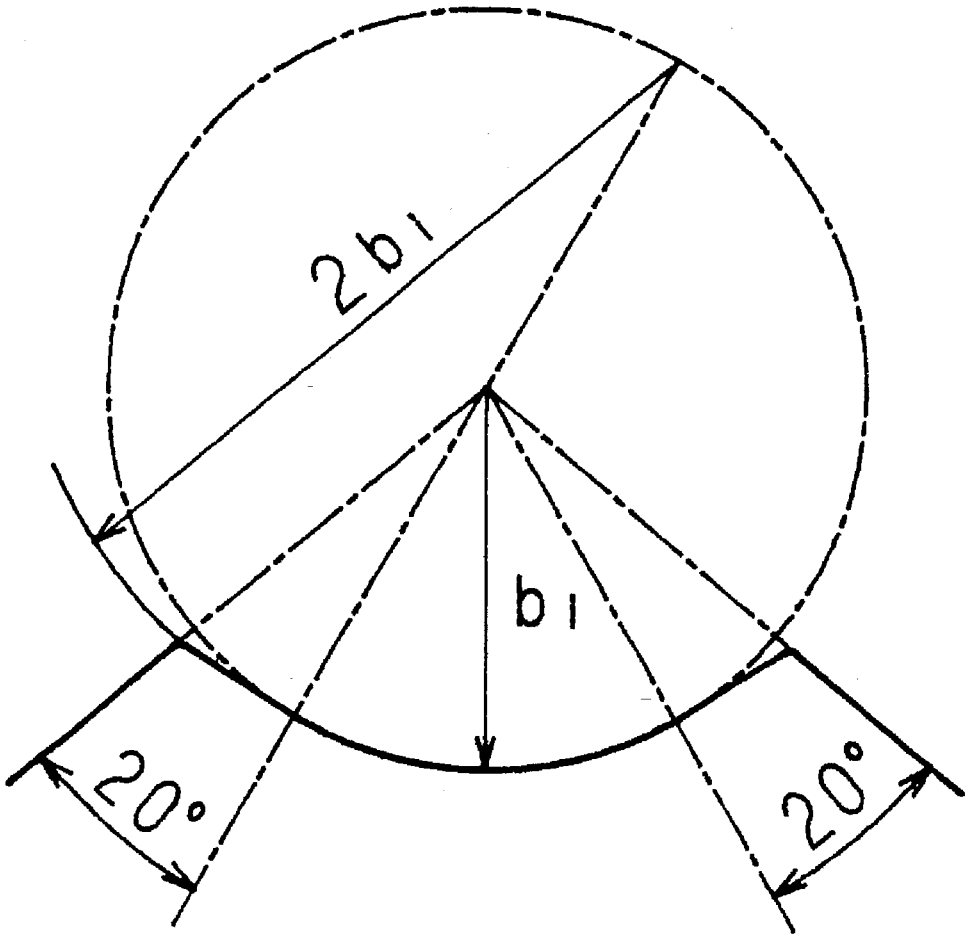
FIG. 13 is an explanatory diagram of a shape of a groove edge of a roll used in the embodiment.

FIG. 13 is an explanatory diagram of the shape of groove edge of a roll being used, and in the following numerical examples, as shown in FIG. 13, the roll of DR type with angle of 20 degrees formed by the groove edge contacting with the arc of radius of 2$b_i$, having the center on the circumference of radius $b_i$ contacting with the groove bottom was used. (Numerical example 1)

| | |
|---|---|
| Steel tube | Material: Low carbon steel<br>Dimensions: ø 95 16 mm × 2 mmt |
| Stand | Number: 5 stands<br>Nominal roll diameter: ø 20 mm<br>First stand roll groove bottom diameter/mother tube diameter: $D_1/D_2$ = approx. 6.6 |

The nominal roll diameter is equal to the distance between confronting roll shafts.

In such conditions, continuous rolling was conducted with the outer diameter reduction per stand being 8, 10, 12, and 14%. As a result, in case of the outer diameter reduction per stand being 8, 10, 12%, the inner surface was not squared after rolling, and overfilling of a mother tube into the roll groove edge was not found. However, the overfilling occurred with the outer diameter reduction per stand being 14%. (Numerical example 2)

| | |
|---|---|
| Steel tube | Material: Low carbon steel<br>Wall thickness: 1.5 or 2.0 mmt |
| Stand | Number: 5 stands + finishing stand<br>Nominal roll diameter: ø 120 mm<br>Outer diameter draft: Approx. 10%/stand |

However, the finishing stand has a caliber being in the same size as the fifth stand and varied about 45 degrees in phase from the pass line.

In such conditions, the steel tube outer diameter $D_2$ (see FIG. 9) was set at ϕ 16, 18, 20, 22, 24 mm, and the corresponding roll groove bottom diameter $D_1$ at ϕ 105.6, 103.8, 102.0, 100.2, 98.4 mm. As a result of defining the $D_1/D_2$ ratio thus at 6.6, 5.8, 5.1, 4.6, 4.1, when the $D_1/D_2$ ratio was over 5.0, the steel tube was caught by the rolls regardless of the wall thickness of the steel tube, but at the $D_1/D_2$ ratio of 5.0 or less, biting failure occurred or slipping between the tube surface and roll occurred. (Numerical example 3)

| | |
|---|---|
| Steel tube | Material: S50C<br>Dimensions: ø 16 mm × 2 mmt |
| Stand | Number: 5 stands + finishing stand<br>Nominal roll diameter: ø 120 mm<br>First stand roll groove bottom diameter/mother tube outer diameter: $D_1/D_2$ = approx. 6.6<br>Reduction in outside diameter: Approx. 9%/stand<br>Caliber pass schedule: ø 14.7 → 13.3 → 12.0 → 10.9 → 10.0 → 10.0 mm<br>(Dimension between roll groove bottoms) |

In such conditions, by setting the peripheral speed ratio of the roll in accordance with the rate of reduction in area of the rolled tube so as to be the reference speed ratio at which the tension between stands may be approximately 0, the peripheral speed of the roll of the sixth stand was 1.5 times the peripheral speed of the roll of the first stand. In this case, the dimensions of the steel tube after rolling were ϕ 15 mm×2.5 mm t. As a result of setting the peripheral speed of the roll of the sixth stand at 2.0, 2.4, 2.7, and 3.0 times the peripheral speed of the roll of the first stand, that is, 1.3, 1.6, 1.8, 2.0 times the reference speed ratio, respectively, the increase of tube wall thickness due to reduction of outer diameter could be suppressed up to 1.8 times of the reference speed ratio, but when exceeding 1.8 times of the reference speed ratio, slipping between the tube and roll surface occurs, and seizure of steel tube on the roll surface occurred.

Figure 14:
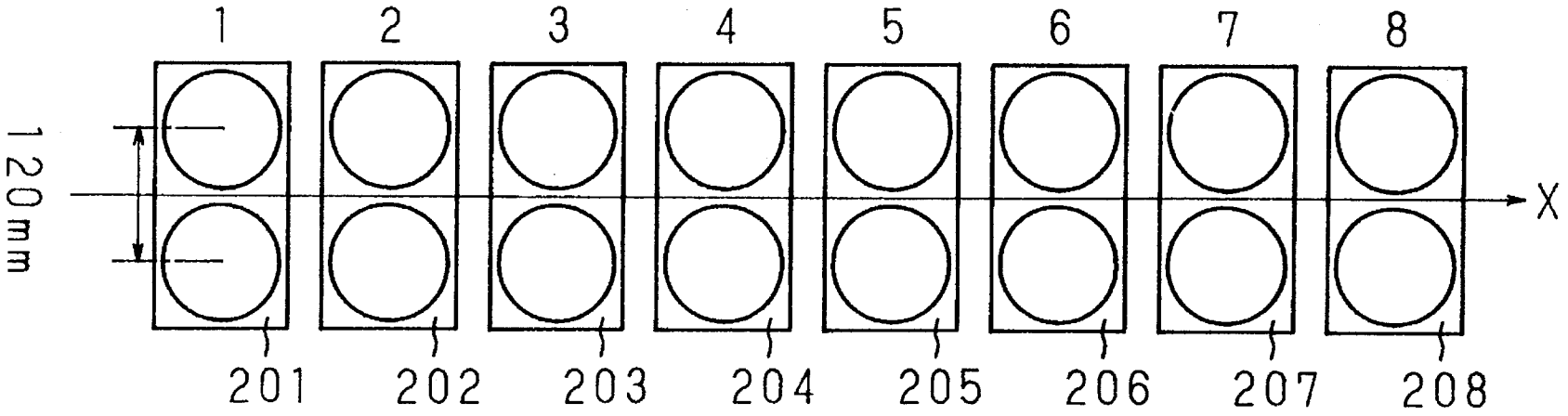
FIG. 14 is a schematic diagram explaining an arrangement of stands in a cold reducer according to the invention.
Figure 15:
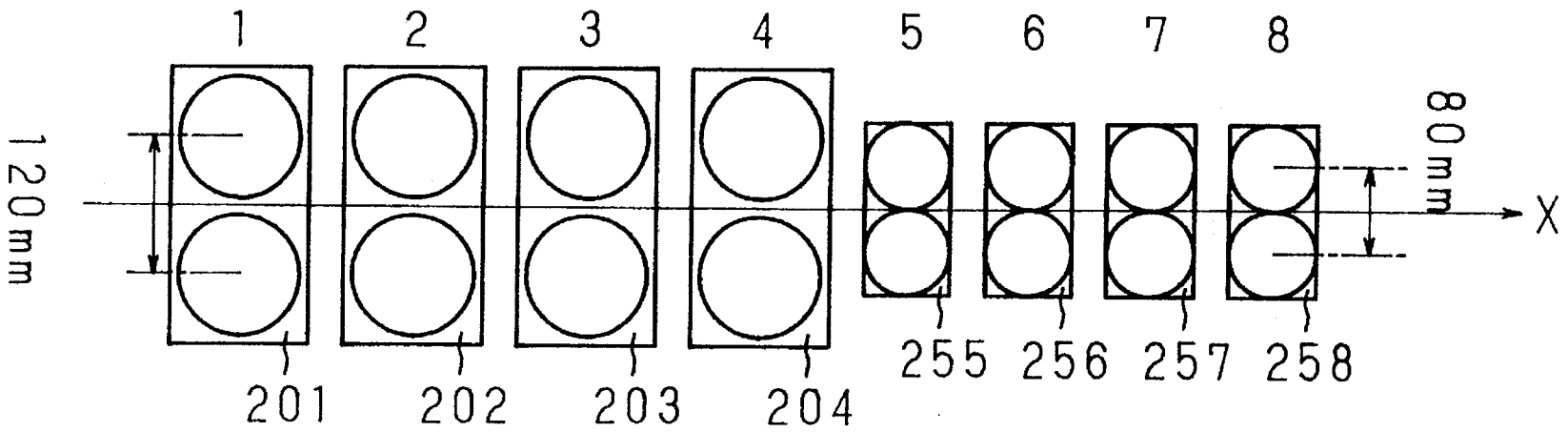
FIG. 15 is a schematic diagram explaining an arrangement of stands in a cold reducer according to the invention.

Incidentally, when the $D_1/D_2$ ratio was varied in every stand as in numerical example 2, the nominal roll diameter may be set constant, or set in plural values. FIG. 14 and FIG. 15 are schematic diagrams for explaining the arrangement of stands having four rolls of the cold reducer according to the invention. In FIG. 14, the nominal roll diameter is set specifically, and in FIG. 15, the nominal roll diameter is set in two types. In the diagrams, 201, 202, . . . , 208, and 251, 252, . . . , 258 are stands, and the mother tube of ϕ 20 mm is rolled in the sequence of stands No. 1, 2, 3, . . . , 8. In the diagrams, the rolls of the stands are arranged in the same direction, but actually they are shifted in phase by 45 degrees each in the neighboring stands.

The radius $D_1$ in the groove bottom of the roll possessed by the stand, the tube outer diameter $D_2$ at the stand entrance side, and $D_1/D_2$ are shown in Table 3.

As shown in Table 3, when the nominal roll diameter is set specifically, the $D_1/D_2$ ratio is large in the latter half stands, and as the roll diameter becomes larger, the facility becomes unnecessarily larger, but by compatibility of stands and sharing of parts, the pass line can be formed by one frame. When the nominal roll diameter is set at ϕ 120 mm and ϕ 80 mm, a large difference is not found in $D_1/D_2$, and since the nominal roll diameter is set small in the latter half stands, the roll diameter may be reduced in the latter half stands.

Figure 16:
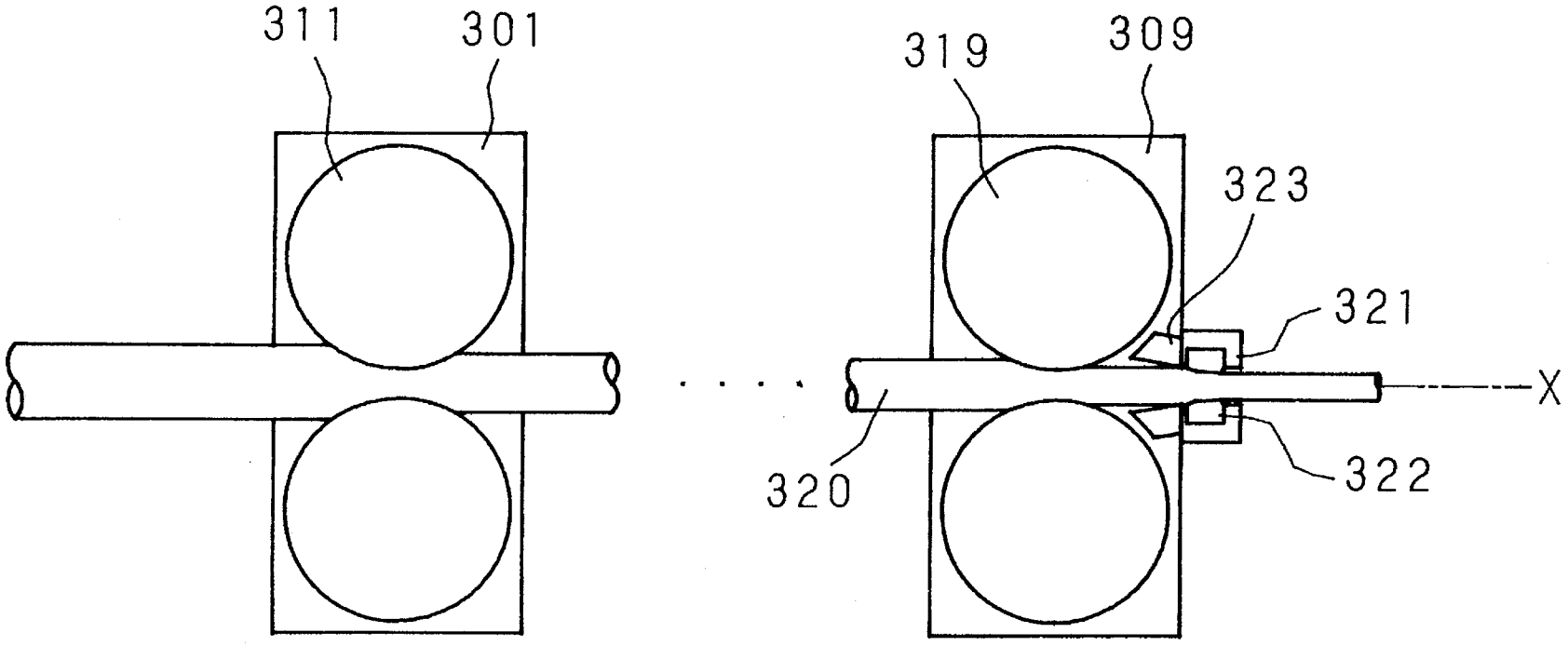
FIG. 16 is a schematic diagram showing a constitution of a tube rolling apparatus according to the invention.
Figure 17:
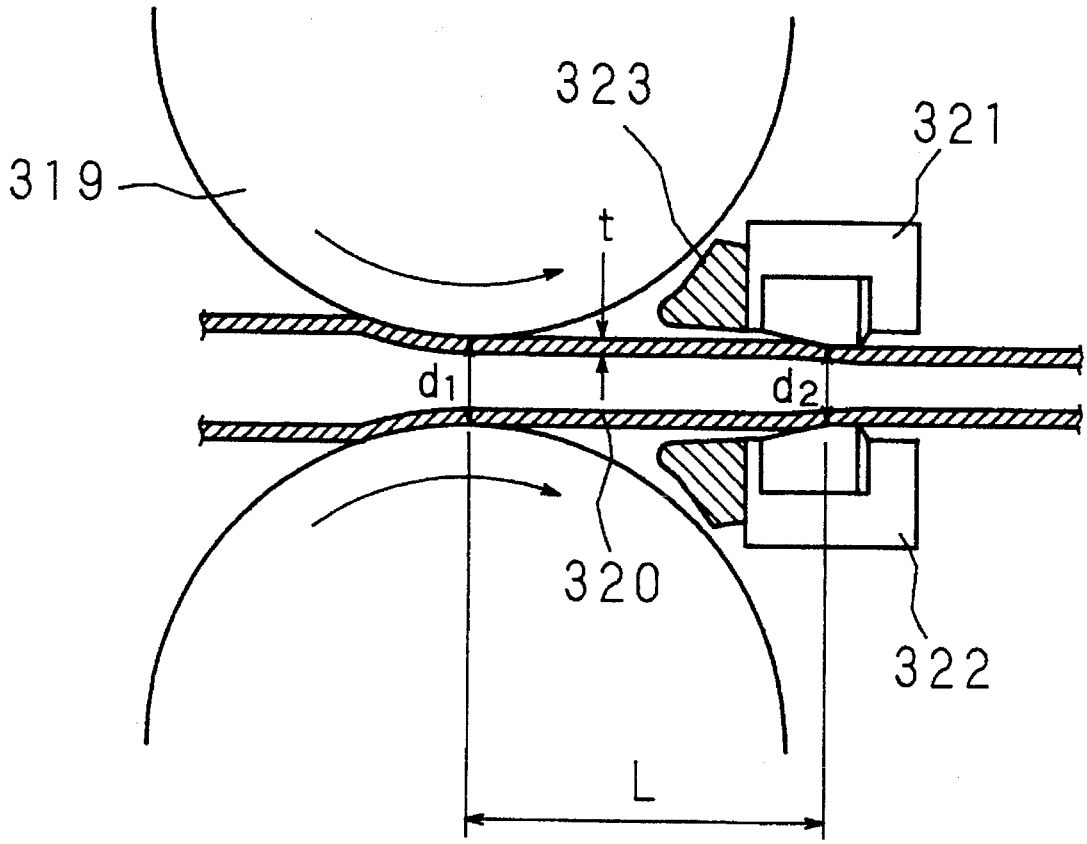
FIG. 17 is a sectional view showing a constitution at downstream side of a tube rolling apparatus according to the invention.

Another embodiment of the invention is specifically described below by referring to the drawings. FIG. 16 is a schematic diagram showing the constitution of a tube rolling apparatus according to the invention, and FIG. 17 is a sectional view magnifying the structure at the downstream side of the rolling apparatus. In the illustrated rolling apparatus, nine stands 301, 302, . . . , 309 are disposed in tandem, and each stand is matched in the caliber individually, and rolls 311, 312, . . . , 319 of the stands are shifted in phase by 45 degrees relatively to the pass line with respect to the rolls of the upstream stands.

Numeral 309 shows the extreme downstream side stand which is the finishing stand, and a die 322 held by a die holder 321 is fixed at the exit side of the extreme downstream side stand 309. A tube material 320 rolled by driving of a roll 319 composing the extreme downstream side stand 309 is guided by a guide 323 fixed at the entrance side of the die 322, and is inserted into the round hole in the die 322 to be sized to a specified dimension.

At both ends of the groove cut in the peripheral surface of the roll for forming the caliber, the caliber radius of the groove edge is set larger than the caliber radius of the groove bottom. Hence, overfilling of the mother tube into the roll gap and flaw of tube at the groove edge can be prevented. Furthermore, as the roll forms the side relief minus caliber as mentioned above, it is possible to roll uniformly in the centripetal direction of tube axis on the mother tube in the roll groove bottom and groove edge. Such roll shape, caliber and driving method are same as in the foregoing embodiments, and the detailed description is omitted.

Using such apparatus, tubes were produced in the following conditions.

| | |
|---|---|
| Steel tube | Material: Low carbon steel<br>Dimensions: ø 18 mm × 2.0 mmt |
| Stand | Number: 8 stands + finishing stand<br>Nominal roll diameter: ø 140 mm<br>Lubricant: Online application of water-soluble liquid<br>Caliber pass schedule: ø 18 → 16.2 → 14.6 → 13.2 → 11.9 → 10.8 → 9.7 → 8.8 → 8.0 → 8.0 (for finishing) mm<br>Tube material mean outer diameter at exit side of extreme downstream side stand: $d_1$ |
| Die | diameter: $d_2$<br>Maximum reduction in outer diameter r: 0.5, 1.5, 2.5, 3.5, 4.5, 5.5<br>Distance L from extreme downstream side stand: 80, 169, 240 mm |

However, the finishing stand has a caliber being in the same size as the eighth stand and varied about 45 degrees in phase from the pass line.

The reduction in outer diameter by the die of the exit side of the extreme downstream side stand is determined in the following formula.

$$r=(d_1-d_2)/d_1\times 100\% \quad (4)$$

Supposing the distance from the caliber center of the extreme downstream side stand to the die entrance in the pass line direction to be L, the following formula is set as the criterion.

$$L\leqq 6\times[\{d_1^4-(d_1-2t)^4\}/(d_1^2-d_2^2)]^{1/2} \quad (5)$$

The result is shown in Table 4.

In Table 4, "○" designates absence of seizure or buckling, and "×" designates presence of seizure or buckling. The reference example employs four rolls, but does not satisfy formula (4) in which r exceeds 5% and/or formula (5). The conditional formula is the value of formula (5) determined in terms of the tube material mean outer diameter $d_1$, die diameter $d_2$, and tube material thickness t.

As clear from Table 4, in this embodiment, a small diameter tube with less wall thickness deviation and higher outer diameter precision as compared with the reference example could be produced without causing seizure or buckling. On the outer surface of the tube material, it is enough to apply soluble oil only, and surface conditioning for lubrication required in the drawing method is not necessary.

In the reference example with the reduction in outer diameter r of the die exceeding 5.0%, the extruding resistance by the die is high, and although buckling could be prevented by narrowing the distance of the roll of the extreme downstream side stand and the die, slip occurred at the upstream side of the second stand in the tube material tail portion, and the tube material was stopped between the rolls. As a result, seizure phenomenon of the tube material on the roll surface occurred. At the reduction in outer diameter r of 7%, seizure occurred in the die, and buckling could not be prevented, too.

At the reduction in outer diameter r of 5.0%, without disposing the die near the roll of the extreme downstream side stand, when the distance L does not satisfy the conditional formula of (5), buckling occurred in the tube material between the die and roll, seizure occurred on the tube material by reducing the diameter at the die, or flaw was formed on the surface of tube material.

At the reduction in outer diameter r of less than 0.5%, although not shown in Table 4, the tube material does not contact with the circumference of the die at several points, and uneven contact occurs. As a result, vertical streaks were often formed on the tube material.

Furthermore, as reference example, by rolling at the reduction in outer diameter of 10% per stand by the three-roll cold stretch reducing method, overfilling occurred at the time of continuous rolling. To prevent this overfilling, it was attempted to form a relief by setting the caliber radius larger for both edges of groove by using the side relief plus caliber, but the wall thickness deviation occurred in the tube material because of the plus side relief, and the inner surface of the tube material was deformed into a hexagon. Incidentally, in case of setting of the reduction in outer diameter of 6% with the side relief minus caliber, overfilling could be prevented, but the inner surface of the tube material was also deformed into a hexagon.

Considering these results, a tube can be produced with the same high outer diameter precision as in the drawing method, for example, the outer diameter precision of $\phi$ 10+−0.02 mm of the drawing method, and wall thickness precision, by sizing the tube material rolled by a four-roll continuous reducer by means of a die. If not sized by die, the outer diameter precision is about $\phi$ ±0.05 min. Besides, reduction rolling of high degree of processing of 50 to 70% by continuous rolling of one pass can be executed, so that continuous rolling can be performed very efficiently. Furthermore, since the roundness of outer diameter is enhanced by sizing, it is possible to roll without deviating the wall thickness even by setting the outer diameter reduction as 10% per stand.

Figure 18:
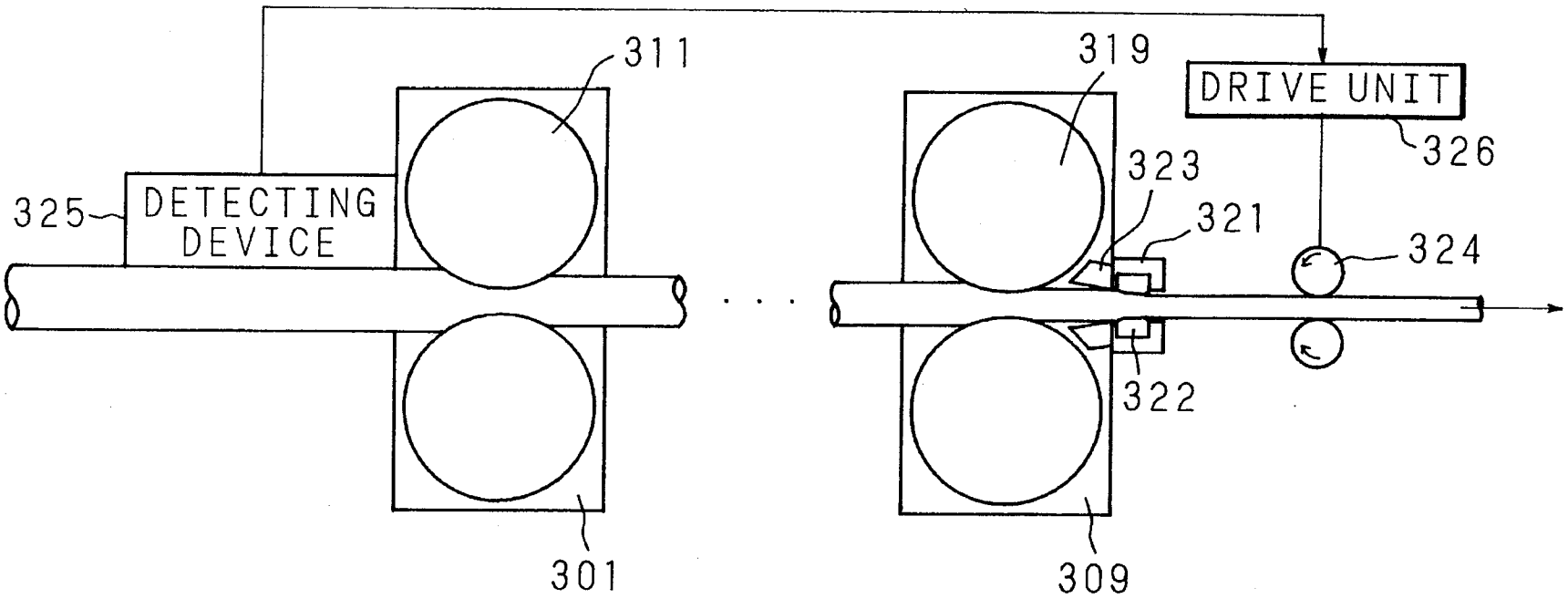
FIG. 18 is a schematic diagram showing a constitution of a tube rolling apparatus according to the invention.

FIG. 18 is a schematic diagram showing the constitution of a tube rolling apparatus according to the invention. In the diagram, numeral 324 designates a pinch roll, which is disposed at the further downstream side of a die 322. The pinch roll 324 comprises two rollers disposed oppositely across a tube material, and by the movement of these rollers, the distance between the rollers is variable. The pinch roll 324 receives a signal from a drive unit 326 having a timer function, and rotates the rollers after a specified time, and the distance between the two rollers is shortened at the same time to hold the tube material.

At the entrance side of an extreme upstream side stand 311, a detecting device 325, which can be an optical sensor, is disposed. The detecting device 325 detects the tail end of the tube to be rolled, and gives a signal to a drive unit, while the drive unit 326 feeds signal to the pinch roll 324 after a specified time, that is, after the lapse of time until the tail end passes through the extreme upstream side stand and is positioned at the exit of the extreme downstream side stand. The other constitution is same as the apparatus shown in FIG. 16 and FIG. 17, and the description is omitted.

For example, when producing a final tube in continuous process, the tail end may stop between the roll of the extreme downstream side stand and the die by the extruding resistance of the die. In such a case, when employing the apparatus in tile above constitution, at first, the tail end of the mother tube is inserted into the extreme upstream side stand 311, and it is detected by the detecting device 325, and its signal is fed into the drive unit 326. Just before the tail end stops after the specified time set in the drive unit 326, a signal is sent from the drive unit 326 into the pinch roll 324. The pinch roll 324 holds the tube material reduced in diameter and rotates it, and the stopped tail end is sent out. After sending out the tail end, the distance between the rollers of the pinch roll 324 is extended, and rotation is stopped.

In this way, continuous production is possible without stopping the tail end of the mother tube. It may be also constituted to hold the tube material always with the pinch roll without using detecting device for sensing the tail end, but useless flaw may be avoided in the constitution with detecting means so as to send out only the minimum required limit of tail end.

Meanwhile, the portion to be pulled out by the pinch roll 324 is the tail end portion of 100 to 200 mm for a tube material length of, for example, 5 to 10 m.

In this embodiment, the detecting device for detecting the tail end of the tube is one optical sensor, but this is not limitative, and an electrostatic proximity sensor may be used, or a plurality of detecting devices may be disposed at the stand entrance side.

In continuous production, if the tail end is not stopped but is pushed out of the die as the front end of a succeeding tube catches up to be joined to the tail end of a preceding tube, or the tail end passes through the die only by the inertial force of the tube material as the rolling speed of the tube material is fast and the rolling reduction of the die is small, it is not necessary to use a pinch roll.

When handling the tube material in coil form, the front end portion of a tube can be wound in a coil form on a take-up machine disposed at the exit side. In this case, pulling of the tail end from the die is performed by the torque of the take-up machine, and the pinch roll is not needed.

Figure 19:
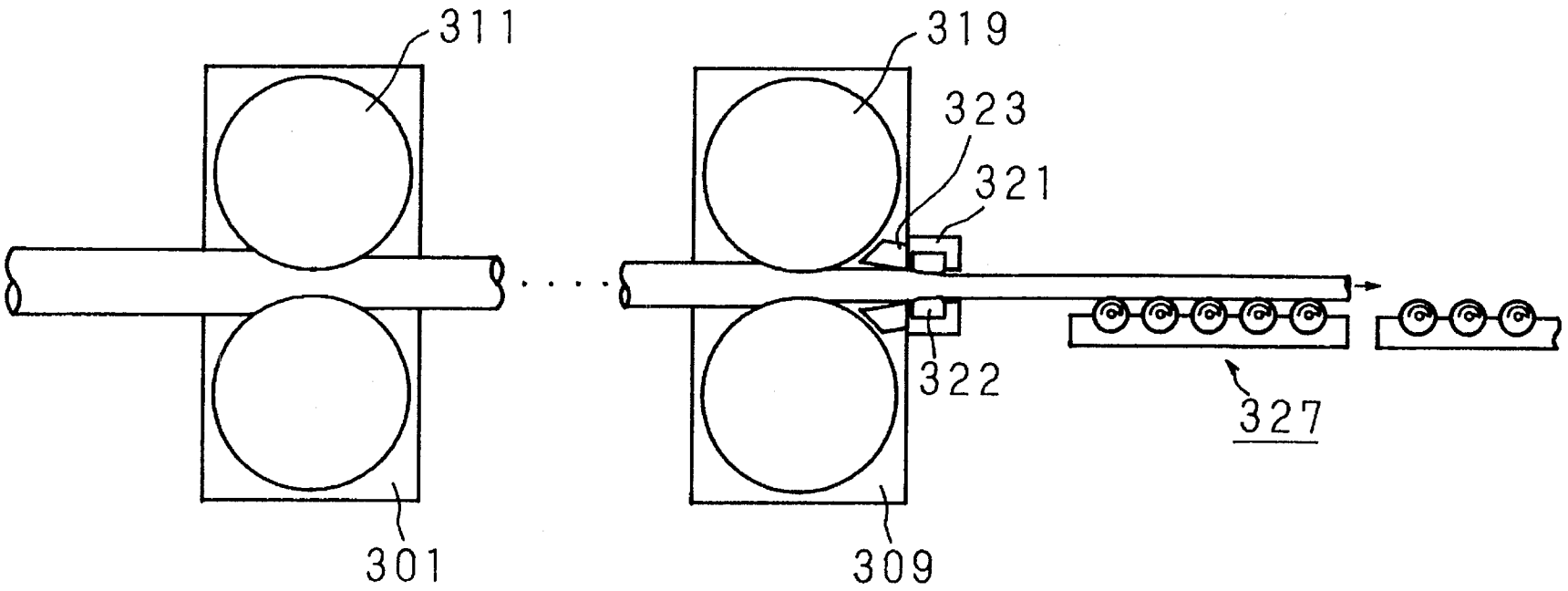
FIG. 19 is a schematic diagram showing a constitution of a tube rolling apparatus according to the invention.

FIG. 19 is a schematic diagram showing the constitution of a tube rolling apparatus according to the invention. In the diagram, numeral 322 designates a die disposed in the bottom of the extreme downstream side stand 319, and a roller table 327 is disposed at the downstream side of this die 322. The roller table 327 comprises plural rollers disposed parallel rotatably, and the tube sized by the die 322 is moved on the upper surface of the roller table 327 and is conveyed. At this time, by setting the tube feed speed of the roller table 327 slightly faster than the tube rolling speed, the tube can be conveyed efficiently. The other constitution is same as the apparatus shown in FIG. 16 and FIG. 17, and the description is omitted.

The tube rolling apparatus and rolling method of the invention described herein may be applied, for example, in producing process of welded tube. When producing a welded tube, it is necessary to change over the type of the welding forming roll in the pass series unit every time the finishing dimension varies, or change the roll conditions such as roll distance of plural types of rolls, and therefore it requires labor in assembling roll stands, or lowers the yield as the tail end and front end of continuous welded tube are out of the product standard. Accordingly by constitution so as to weld the tube to be welded in a specified size and insert tile welded tube into the extreme upstream side stand of the apparatus of the invention, the finishing dimension can be easily changed only by changing the arrangement of the roll units of the apparatus of the invention, without exchanging the welding forming rolls, so that the welded tubes may be produced at high yield.

As described so far, in the tube rolling method and apparatus of the invention, since the radius of the edge portion is set longer than the radius of the middle part in the groove of the roll for forming the caliber, cold rolling can be performed without squaring the inner surface after rolling of tube, and products of high dimensional precision and surface quality can be produced, and the yield is enhanced at the same time. Besides, the reduction per stand can be set high, and the total number of stands can be decreased, and the facility cost is lowered. Thus, the invention offers outstanding effects.

Since the diameter of the roll for the outer diameter of the tube to be rolled can be set smaller than in the three-roll type, the facility is smaller in scale and the facility cost is lower, and the stand interval can be shortened, thereby decreasing the number of rolled tubes going out of gauge, and the reduction in outer diameter of the tube can be raised, so that the total number of stands required for reducing the outer diameter to specified value may be decreased, and moreover a tension between stands can be obtained without slipping of rolls, thereby suppressing the increase of wall thickness due to reduction of outer diameter of the tube to be rolled. Thus, the invention offers the excellent effects.

Furthermore, after rolling by using four rolls with the caliber with the radius of the middle part longer than the radius of the edge part in the roll groove, by sizing the outer diameter under slight reduction by the die fixed at the exit side of the extreme downstream side stand, a high roundness of outer diameter of the same level as in drawing method can be obtained without reducing process, so that tubes may be produced at high dimensional precision and high yield. By the sizing, still more, the roundness of outer diameter is high, and by installing one finishing stand in the final place, the diameter can be reduced to a desired size by a small number of stands, and it is not necessary to use different pass series for each finishing dimension.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

TABLE 1

| test No. | caliber type | caliber shape | reduction per stand | $b_i/b_{i-1}$ | $a_i/b_{i-1}$ | α | rolling result: over-filling | rolling result: interior squareness |
|---|---|---|---|---|---|---|---|---|
| embodiment | | | | | | | | |
| 1 | DR | θ = 15° | 10% | 0.90 | 0.916 | 0.84 | ○ | ○ |
| 2 | DR | θ = 22.5° | 10% | 0.90 | 0.935 | 0.65 | ○ | ○ |
| 3 | SR | R = 1.1 r | 10% | 0.90 | 0.924 | 0.76 | ○ | ○ |
| 4 | SR | R = 1.15 r | 10% | 0.90 | 0.935 | 0.65 | ○ | ○ |
| 5 | SR | R = 1.2 r | 12% | 0.88 | 0.924 | 0.63 | ○ | ○ |
| reference example | | | | | | | | |
| 6 | DR | θ = 5° | 10% | 0.90 | 0.902 | 0.98 | X | ○ |
| 7 | DR | θ = 10° | 10% | 0.90 | 0.907 | 0.93 | Δ | ○ |
| 8 | SR | R = 1.2 r | 10% | 0.90 | 0.945 | 0.55 | ○ | Δ |
| 9 | SR | R = 1.4 r | 10% | 0.90 | 0.979 | 0.21 | ○ | Δ |
| 10 | SR | R = 1.6 r | 10% | 0.90 | 1.007 | −0.07 | ○ | X |
| 11 | SR | R = 1.3 r | 7% | 0.93 | 0.996 | 0.06 | ○ | Δ |
| 12 | SR | R = 1.4 r | 7% | 0.93 | 1.012 | −0.17 | ○ | X |
| 13 | SR | R = 1.2 r | 13% | 0.87 | 0.914 | 0.66 | X | ○ |

TABLE 2

| $e/b_i$ | $a_i/b_i$ | interior squareness |
|---|---|---|
| 0.10 | 1.027 | ○ |
| 0.15 | 1.039 | ○ |
| 0.20 | 1.050 | ○ |
| 0.25 | 1.061 | X |

TABLE 3

| stand No. | 1 | 2 | 3 | 4 | 5 | 6 | 7 | 8 |
|---|---|---|---|---|---|---|---|---|
| specified nominal roll diameter | | | | | | | | |
| $D_1$ (mm) | 102 | 103.8 | 105.4 | 106.9 | 108.2 | 109.4 | 110.4 | 110.4 |
| $D_2$ (mm) | 20 | 18 | 16.2 | 14.6 | 13.1 | 11.8 | 10.6 | 9.6 |
| $D_1/D_2$ | 5.1 | 5.8 | 6.5 | 7.3 | 8.3 | 9.3 | 10.4 | 11.5 |
| nominal roll diameter at two type | | | | | | | | |
| $D_1$ (mm) | 102 | 103.8 | 105.4 | 106.9 | 68.2 | 69.4 | 70.4 | 70.4 |
| $D_2$ (mm) | 20 | 18 | 16.2 | 14.6 | 13.1 | 11.8 | 10.6 | 9.6 |
| $D_1/D_2$ | 5.1 | 5.8 | 6.5 | 7.3 | 5.2 | 5.9 | 6.6 | 7.3 |

TABLE 4

| | r (%) | L (mm) | calculated value according to equation(5) (mm) | seizure | buckling |
|---|---|---|---|---|---|
| embodiment | 0.5 | 80 | 461 | ○ | ○ |
| | | 160 | | ○ | ○ |
| | | 240 | | ○ | ○ |
| | 1.5 | 80 | 267 | ○ | ○ |
| | | 160 | | ○ | ○ |
| | | 240 | | ○ | ○ |
| | 2.5 | 80 | 207 | ○ | ○ |
| | | 160 | | ○ | ○ |
| reference example | | 240 | | ○ | X |
| embodiment | 3.5 | 80 | 176 | ○ | ○ |
| | | 160 | | ○ | ○ |
| reference example | | 240 | | ○ | X |
| embodiment | 4.5 | 80 | 155 | ○ | ○ |
| reference | | 160 | | ○ | X |
| example | | 240 | | ○ | X |
| | 5.5 | 80 | 141 | X | ○ |
| | | 160 | | X | X |
| | | 240 | | X | X |

What is claimed is:

1. A tube rolling method, comprising the steps of:

disposing a plurality of stands along a longitudinal pass line, each stand having four rolls in tandem, wherein the rolls of a preceding stand and of a succeeding stand differ in phase by about 45 degrees relative to the pass line formed by the stands, and the rolls include roll grooves for forming a nearly circular caliber; and continuously passing a tube in a cold state through said plurality of stands such that an outer diameter of the tube is rolled and reduced;

wherein the roll grooves satisfy the following conditions:

$$a_i > b_i$$

$$a_i < b_{i-1}$$

where $a_i$ is a caliber radius of a roll groove edge of an i-th stand;

$b_i$ is a caliber radius of a roll groove center of the i-th stand; and $b_{i-1}$ is a caliber radius of a roll groove center of an i–1-th stand.

2. A tube rolling method as set forth in claim 1, wherein said rolls possess roll grooves for forming a nearly circular caliber satisfying the following conditions:

$$1.0 < a_i/b_i \leqq 1.050.$$

3. A tube rolling method as set forth in claim 1, wherein said rolls possess roll grooves having a substantially constant radius of curvature, for forming a nearly circular caliber satisfying the following conditions:

$$1.05b_i \leqq R_i \leqq 1.20b_i$$

where $R_i$ is a radius of curvature of a roll caliber of an i-th stand.

4. A tube rolling method as set forth in claim 1, wherein said rolls possess roll grooves for forming a nearly circular caliber satisfying the following conditions:

$$0.88 \leqq b_i/b_{i-1} \leqq 0.95;$$

and $$0.60 \leqq (b_{i-1}-a_i)/(b_{i-1}-b_i) \leqq 0.90.$$

5. A tube rolling method as set forth in claim 2, wherein said rolls possess roll grooves for forming a nearly circular caliber satisfying the following conditions:

$$0.88 \leqq b_i/b_{i-1} \leqq 0.95;$$

and $$0.60 \leqq (b_{i-1}-a_i)/(b_{i-1}-b_i) \leqq 0.90.$$

6. The tube rolling method of claim 3, wherein said rolls possess roll grooves for forming a nearly circular caliber satisfying the following conditions:

$$0.88 \leqq b_i/b_{i-1} \leqq 0.95;$$

and $$0.60 \leqq (b_{i-1}-a_i)/(b_{i-1}-b_i) \leqq 0.90.$$

7. The tube rolling method of claim 1, wherein said step for continuously passing the tube through said plurality of stands is executed such that the outer diameter of the tube is reduced by 12% or less per stand, and wherein a roll groove bottom diameter is five times or more of the outer diameter of the tubes to be rolled.

8. A tube rolling method as set forth in claim 7, wherein said step for continuously passing the tube through the plurality of stands is executed by adjusting a peripheral speed of the rolls of the stands, so that an acceleration ratio of a peripheral speed in a middle of the groove of the roll at an extreme downstream side stand to a peripheral speed in a middle of the groove of the roll of an extreme upstream side stand of said tube to be rolled is about 1.0 times to 1.8 times a reference acceleration ratio in which no tension acts on the tube.

9. A tube rolling method as set forth in claim 1, further comprising the step of:

sizing a tube which has been rolled and reduced, by using a die disposed at an exit side of an extreme downstream side stand of said stands.

10. A tube rolling method as set forth in claim 9, wherein said sizing step is executed such that an outer diameter reduction in the die is about 0.5 to 5.0%.

11. A tube rolling method as set forth in claim 9, wherein said die is located at a position where a distance L between a center of said nearly circular caliber of an extreme downstream side stand and an entrance of a bearing portion of said die satisfies the following formula:

$$L \leqq 6 \times [\{d_1^4-(d_1-2t)^4\}/(d_1^2-d_2^2)]^{1/2}$$

where $d_1$ is a caliber diameter of a roll of the extreme downstream side stand;

t is a wall thickness of the tube at an exit of the extreme downstream side stand; and $d_2$ is a die diameter.

12. A tube rolling method as set forth in claim 9, further comprising the step of:

pulling out a tail end portion of said tube by using a pinch roll disposed at an exit side of said die when said tail end portion is stopped between said roll and die.

13. A tube rolling method as set forth in claim 12, wherein the pulling step further includes:

detecting the tail end portion of said tube by using at least one detecting means disposed at an entrance side of said plurality of stands or between stands; and operating or stopping said pinch roll based on said detection.

14. A tube rolling method as set forth in claim 9, further comprising the step of:

conveying the sized tube by using tube conveying means disposed at an exit side of said die, wherein a conveying speed of said tube conveying means is greater than a speed of said tube at the exit side of said die.

15. A tube rolling method as set forth in claim 14, wherein said tube conveying means comprises a roller table.

16. A tube producing apparatus, comprising:

a plurality of stands, arranged along a longitudinal pass line, for reducing an outer diameter of a tube passing through the stands in a cold state;

wherein each stand includes four rolls in tandem, the rolls of a preceding stand and of a succeeding stand differing in phase by about 45 degrees relative to the pass line formed by the stands, the rolls having roll grooves which form a nearly circular caliber, the roll grooves satisfying the following conditions:

$$a_i > b_i;$$

and $$a_i < b_{i-1}$$

where $a_i$ is a caliber radius of a roll groove edge of an i-th stand;

$b_i$ is a caliber radius of a roll groove center of the i-th stand; and $b_{i-1}$ is a caliber radius of a roll groove center of an i−1-th stand.

17. A tube producing apparatus as set forth in claim 16, wherein said rolls possess roll grooves satisfying the following condition:

$$1.0 < a_i/b_i < 1.050.$$

18. A tube producing apparatus as set forth in claim 16, wherein said rolls possess roll grooves having a substantially constant radius of curvature satisfying the following conditions:

$$1.05b_i \leqq R_i \leqq 1.20b_i$$

where $R_i$ is a radius of curvature of a roll caliber of an i-th stand.

19. A tube producing apparatus as set forth in claim 16, wherein said rolls possess roll grooves satisfying the following conditions:

$$0.88 \leqq b_i/b_{i-1} \leqq 0.95;$$

and $$0.60 \leqq (b_{i-1}-a_i)/(b_{i-1}-b_i) \leqq 0.90.$$

20. A tube producing apparatus as set forth in claim 17, wherein said rolls possess roll grooves satisfying the following conditions:

$$0.88 \leqq b_i/b_{i-1} \leqq 0.95;$$

and $$0.60 \leqq (b_{i-1}-a_i)/(b_{i-1}-b_i) \leqq 0.90.$$

21. A tube producing apparatus as set forth in claim 18, wherein said rolls possess roll grooves satisfying the following conditions:

$$0.88 \leqq b_i/b_{i-1} \leqq 0.95;$$

and $$0.60 \leqq (b_{i-1}-a_i)/(b_{i-1}-b_i) \leqq 0.90.$$

22. A tube producing apparatus as set forth in claim 16, wherein said rolls possess a roll groove bottom diameter of five times or more of an outer diameter of said tube.

23. A tube producing apparatus as set forth in claim 16, further comprising:

a die for sizing the reduced tube, the die being disposed at an exit side of an extreme downstream side stand of said plurality of stands.

24. A tube producing apparatus as set forth in claim 23, wherein said die is located at a position where a distance L between a center of said nearly circular caliber of said extreme downstream side stand and an entrance of a bearing portion of said die satisfies the following formula:

$$L \leqq 6 \times [)\{d_1^4-(d_1-2t)^4\}/(d_1^2-d_2^2)]^{1/2}$$

where $d_1$ is a caliber diameter of a roll of the extreme downstream side stand;

t is a wall thickness of the tube at an exit of the extreme downstream side stand; and $d_2$ is a die diameter.

25. A tube producing apparatus as set forth in claim 23, further comprising:

a pinch roll for pulling out a tail end portion of said tube, the pinch roll being disposed at an exit side of said die.

26. A tube producing apparatus as set forth in claim 25, further comprising:

at least one detecting means for detecting the tail end portion of said tube, the detecting means being disposed at an entrance side of said plurality of stands or between the stands, wherein said pinch roll operates or stops according to the detection of said detecting means.

27. A tube producing apparatus as set forth in claim 23, further comprising:

tube conveying means for conveying the sized tube, the tube conveying means being disposed at an exit side of said die.

28. A tube producing apparatus as set forth in claim 27, wherein said tube conveying means comprises a roller table.

* * * * *